US006391825B1

(12) United States Patent
Arai et al.

(10) Patent No.: US 6,391,825 B1
(45) **Date of Patent: *May 21, 2002**

(54) IMAGE-RECEIVING SHEET FOR RECORDING AND PROCESS FOR THE PRODUCTION THEREOF

(75) Inventors: Toshio Arai; Chikashi Sano, both of Kobe; Fumio Matsui; Takanori Mitsuhata, both of Tsurugashima, all of (JP)

(73) Assignee: Bando Chemical Industries, Ltd., Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/517,632

(22) Filed: Mar. 3, 2000

Related U.S. Application Data

(63) Continuation-in-part of application No. 09/155,488, filed as application No. PCT/JP98/00378 on Jan. 28, 1998, now Pat. No. 6,326,055.

(30) Foreign Application Priority Data

| | | |
|---|---|---|
| Jan. 29, 1997 | (JP) | 9-015086 |
| Apr. 8, 1997 | (JP) | 9-089681 |
| Apr. 8, 1997 | (JP) | 9-089682 |
| Apr. 24, 1997 | (JP) | 9-107806 |
| Apr. 24, 1997 | (JP) | 9-107807 |
| Apr. 25, 1997 | (JP) | 9-108742 |
| Apr. 28, 1997 | (JP) | 9-110802 |
| Apr. 28, 1997 | (JP) | 9-110803 |

(51) Int. Cl.[7] ..... B41M 5/035; B41M 5/38

(52) U.S. Cl. ..... 503/227; 427/152; 427/195; 428/195

(58) Field of Search ..... 8/471; 428/913, 428/914, 195, 212, 327, 447; 503/227; 427/152, 195, 180

(56) References Cited

U.S. PATENT DOCUMENTS

| | | | | |
|---|---|---|---|---|
| 5,232,893 A | * | 8/1993 | Kawasaki et al. | 503/227 |
| 5,771,431 A | * | 6/1998 | Mitsuhata et al. | 399/307 |

FOREIGN PATENT DOCUMENTS

| | | |
|---|---|---|
| JP | 7-47326 | 2/1995 |
| JP | 8-224970 | 9/1996 |

* cited by examiner

*Primary Examiner*—Bruce H. Hess
(74) *Attorney, Agent, or Firm*—Wenderoth, Lind & Ponack, LLP

(57) ABSTRACT

There is provided an image-receiving sheet for recording with dye or ink which comprises a base sheet and a resin layer comprising a powdery coating composition which contains a resin component as a dye- or ink-receiving layer on the base sheet. There is further provided a process for the production of such an image-receiving sheet which comprises dry-coating a powdery coating composition which contains a resin component on a base sheet by an electrostatic spraying process, heating, melting and fixing the powdery coating composition thereon to form a resin layer as a dye- or ink-receiving layer.

9 Claims, 1 Drawing Sheet

IMAGE-RECEIVING SHEET FOR RECORDING AND PROCESS FOR THE PRODUCTION THEREOF

This is a divisional application Ser. No. 09/155,488, filed Feb. 18, 1999, now U.S. Pat. No. 6,326,055, which is a 371 of PCT/JP98/00378, filed Jan. 28, 1998.

TECHNICAL FIELD

The present invention generally relates to an image-receiving sheet for recording by use of colorants which contain dye or pigment and a process for the production thereof.

More particularly, the invention relates to an image-receiving sheet which has on a base sheet a dye- or ink-receiving layer for use in a variety of printing or recording processes by use of a variety of dyes or inks, preferably for use in printing or recording processes by thermal transfer of sublimable dyes, thermal transfer of meltable dyes, or in ink jet printing or make-up printing processes, and a process for the production of such image-receiving sheets. The dye- or ink-receiving layer is hereinafter often simply referred to as a receiving layer.

According to one of specific embodiments of the invention, it relates to an image-receiving sheet for use in recording by thermal transfer of dye or ink which has on a base sheet a high performance dye- or ink- receiving layer when dye or ink is transferred onto the layer by heat, and a process for the production of such image-receiving sheets.

BACKGROUND ART

There have been known a variety of recording or printing processes to record or print information such as letters or images with dye or ink on an image-receiving sheet for recording, usually on an image-receiving paper for recording. However, whatever printing process may be employed, the image-receiving sheet for use in such printing processes is in general such that it has a single layer or a plurality of layers on a base sheet formed by coating a solution or dispersion of a suitable substance in a solvent thereon to prevent dye or ink from spreading or to fix dye or ink on the base sheet. Consequently, the conventional image-receiving sheets for such recording processes are expensive on the one hand on account of many steps required for the production, and on the other hand, since any of the printing processes has its own properties, it is needed to use a specially prepared image-receiving sheet for recording to obtain high-quality printing according to the printing process employed.

For instance, for electrophotographic image formation, a method is known for forming multi-color images which comprises selectively exposing a photoreceptor through an original image via a color separator capable of separating the original image into predetermined primary colors, thereby forming a latent image on the photoreceptor, followed by developing the latent image into a visible image corresponding to the primary color with transferring the thus developed visible image on an image-receiving sheet one after another to give a multi-color image on the sheet. For example, with successively transferring the developed visible images of three colors of yellow, magenta and cyan, so-called full-color transfer image duplications can be formed on the image-receiving sheet. This process is a multi-color image-forming process using a so-called, dye-transferring full-color printer.

To such full-color duplication, popularly applied is recording by thermal transfer of sublimable dye, for which, for example, employed is a thermal transfer recording process comprising preparing a thermal transfer sheet that has a sublimable dye layer as formed on a suitable support, such as a polyethylene terephthalate film (this sheet is generally referred to as an ink sheet or an ink film in the art, and will be hereinafter referred to as the former, ink sheet), while, on the other hand, separately preparing a thermal transfer image-receiving sheet having on its surface a receiving layer capable of receiving the sublimed dyes, thereafter laying the ink sheet onto the image-receiving sheet in such a manner that the surface of the dye layer of the former faces the surface of the receiving layer of the latter, then heating the ink sheet with a heating means such as a thermal head in accordance with image information to be transferred onto the image-receiving sheet to thereby thermally transfer the dyes from the ink sheet onto the receiving layer of the image-receiving sheet in accordance with the image information.

The conventional thermal transfer image-receiving sheet for use in such a sublimation thermal transfer recording process is generally produced by lamination through wet-coating of a plurality of resin layers on a base sheet, such as paper, synthetic paper, or suitable synthetic resin sheets, for example, in such a manner that a receiving layer made of resins to which the dyes existing on an ink sheet can be diffused or transferred under heat, and a releasing layer made of resins which acts to prevent the thermal fusion between the receiving layer and the ink sheet are laminated on the base sheet in that order.

Concretely, the conventional thermal transfer image-receiving sheet is produced by applying onto a base sheet a solution comprising resins to constitute a receiving layer on the base sheet, then drying the solution to thereby form the intended receiving layer of the resin on the base sheet, thereafter applying thereonto a solution comprising resins to form a releasing layer, and drying the solution to form the intended releasing layer of the resins on the receiving layer of the resins. Therefore, such a plurality of resin layers each having a different function are laminated on the base sheet. If desired, an undercoat layer or an interlayer may be formed between the base sheet and the receiving layer. Accordingly, the process for producing the conventional thermal transfer image-receiving sheet is complicated, and the production costs are high.

Apart from the recording system of the above-mentioned type, a different, thermal transfer full-color printing process has also been proposed, in which a resin layer is previously laminated on an ink sheet, the resin layer is first thermally transferred from the ink sheet onto an image-receiving sheet to form thereon a receiving layer prior to the transference of yellow, magenta, cyan and black dyes thereonto in that order, and thereafter these dyes are thermally transferred onto the thus formed receiving layer on the image-receiving sheet.

However, this process is problematic in that the first transference of the resin layer takes much time, resulting in the prolongation of the time for the intended full-color printing, that the formation of a uniform receiving layer on common paper is not easy, and that the quality of the transfer image to be finally obtained is poor. In addition, it is further problematic in that the lamination of the resin layer (this layer is, as mentioned above, to be the receiving layer on the image-receiving sheet) on the surface of the ink sheet is technically difficult. At any rate, for the recording-process by thermal transfer of sublimable dye, a specially prepared image-receiving sheet for use has has hitherto been needed.

On the other hand, a thermally meltable (i.e., capable of melting) ink transfer printing process is also well known, in which ink on an ink sheet is heated and melted, and is then transferred and fixed on a thermal transfer image-receiving sheet. As seen, the image-receiving sheet for use in thermally meltable ink transfer printing process comprises a base sheet and a microporous resin layer thereon to receive the melted ink. Thus, the thermally meltable ink transfer printing process also needs a specially prepared image-receiving sheet.

An ink jet printing process is also known. This printing process uses aqueous ink jet ink so that it also needs a specially prepared image-receiving sheet for use which comprises a base sheet and a colorant-receiving layer to be dyed and a moisture absorbing layer to absorb excess water in the ink. A typical image-receiving sheet for this ink jet printing process has on a base sheet, for example, a moisture absorbing layer formed of water-soluble resins and a colorant-receiving layer formed of, for example, cationic acrylic resins. Meanwhile, an ink jet printing process in which solid ink is used is also known, in which an image-receiving sheet which has a microporous resin layer on a base sheet to receive the ink is used.

Finally, even in a printing system in which a plate, such as a letterpress, is used, high quality, high darkness printing is obtained without ink spreading only when resin-coated and flat surface paper, such as art paper, calender roll paper or offset paper is used to receive printing ink effectively.

As described above, whatever printing process may be employed, it has been necessary to use a specially prepared image-receiving sheet which has on a base sheet a dye- or ink-receiving layer in a single layer or in a plurality of layers according to the printing process employed so that a high quality printing or image is realized. On the contrary, when common paper is used as an image-receiving sheet, a desired high-quality printing or image has not been realized. Thus, so far, any of the printing processes mentioned above produces a high quality printed image when an image-receiving sheet specially prepared so as to be suited to the process employed is used, but this apparently costs a great deal.

The use of such a specially prepared image-receiving sheet involves further problems. Very often the conventional sheet has a very flat surface, or on the contrary it has a very porous surface according to the printing process in use. In particular, since many of the conventional thermal transfer image-receiving sheets have on base sheets dye- or ink-receiving layers and releasing layers formed by wet-coating so that such dye- or ink-receiving layers are excessively flat and glossy. That is, usually the dye- or ink-receiving layers have a surface roughness Ra in the range of 0.2–0.4 and a ten point average roughness in the range of 1.5–2.0 as measured in accordance with JISB 0601-1994. Thus, it is difficult to write on such a flat surface with a common writing instrument such as a pencil, fountain pen or ball-point pen. It is also difficult to obtain a grayed printed image having a feeling of quality.

The conventional thermal transfer image-receiving sheet is generally produced through wet-coating of a plurality of resin layers each having a different function laminated on a base sheet. Accordingly, when common paper is used as the base sheet, it is usually difficult to form receiving layers on both sides of common paper. That is, it is not possible to form thermal transfer images on both sides of common paper.

Moreover, the conventional thermal transfer image-receiving sheet has, in general, a receiving layer only on the front of the base sheet and hence has a different layer structure on the front from that of the back so that it is apt to curl depending upon the ambient humidity or temperature conditions to reduce commercial value. In particular, when paper is used as a base sheet and a receiving layer is formed on the front, the base paper absorbs moisture and swells under a high humidity whereas the receiving layer is low in absorbency since it is formed of resins so that the image-receiving sheet curls and hence is reduced in commercial value. As a further problem, a thermal transfer image-receiving sheet is placed under a high temperature of 200–500° C. momentarily when an image is thermally transferred from an ink sheet. Thus, when the sheet contains moisture, it evaporates very rapidly and the sheet curls remarkably.

As described above, the conventional image-receiving sheets for recording with dye or ink, especially such a sheet in which paper is used as a base sheet, have a plurality of layers such as receiving layers and releasing layers formed by multi-step wet-coating processes on the base sheet, and accordingly they are expensive as well as they have a variety of problems as stated above.

To cope with these problems, there has been proposed a process for the production of an image-receiving sheet for sublimation thermal transfer recording which comprises dry-coating a powdery coating composition which contains a resin component therein on a base sheet, and heating, melting and fixing the powdery coating composition on the base sheet to form a dye- or ink-receiving layer comprised of a continuous resin coating or film, as disclosed in Japanese Patent Application Laid-open No. 8-112974. According to the process, a receiving layer can be easily formed on a base sheet, even if paper is used as a base sheet. Accordingly, the process provides a thermal transfer image-receiving sheet in an inexpensive manner.

However, the image-receiving sheet thus produced has other problems. In particular, since paper is comprised of cellulose fibers and has an uneven or undulating surface, when it is used as a base sheet and a receiving layer formed thereon is thin, the layer follows the uneven or undulating surface. As results, when an ink sheet is attached to the image-receiving sheet under heat to transfer the dye of the ink sheet to the image-receiving sheet, a clear image cannot be obtained on account of lack of uniform contact between the ink sheet and the image-receiving sheet. This tendency is remarkable especially when the surface of a base paper has an unevenness or undulation not less than 10 $\mu$m in height.

The invention has been made in order to solve the above-mentioned problems associated with the conventional various printing processes, in particular, image-receiving sheets and their production.

Specifically, it is an object of the invention to provide a simple and inexpensive process for producing an image-receiving sheet having a dye- or ink-receiving layer on a base sheet, preferably on paper, for use in a variety of printing processes to form high quality images thereon, preferably image-receiving sheet for recording by thermal transfer of sublimable dyes or thermally meltable inks, ink jet printing or plate printing. It is also an object of the invention to provide a process for producing such image-receiving sheets for recording by such printing processes.

More specifically, it is an object of the invention to provide a process for producing an image-receiving sheet easily and inexpensively, if necessary, by use of a long-size continuous base sheet, for use in any of printing processes by thermal transfer of sublimable dyes or thermally meltable inks, ink jet printing process or plate printing process to form high quality images, by dry-coating a powdery coating composition by an electrostatic spraying process on a base sheet, and heating, melting and fixing the composition thereon to form a dye- or ink-receiving layer.

A further object of the invention is to provide a thermal transfer image-receiving sheet which comprises a base sheet and a single receiving layer thereon comprised of a powdery coating composition, and yet has a good releasability from an ink sheet, and moreover which is produced by a simple process.

A still further object of the invention is to provide a thermal transfer image-receiving sheet which has a dye- or ink-receiving layer having a predetermined thickness on a base sheet, in particular, a base paper, to compensate or offset the unevenness or undulation of the surface of the base paper, and which accordingly can form a clear image with no defect.

It is also an object of the invention to provide a thermal transfer image-receiving sheet which has a receiving layer of which surface is moderately uneven, that is, matted, so that it forms an image having a feeling of quality and an ordinary writing instrument writes well on the sheet.

It is still an object of the invention to provide a process for producing a two-layer structure thermal transfer image-receiving sheet which has a receiving layer on a base sheet and a releasing layer thereon so that it has good releasabilty from an ink sheet.

In addition to above, a still further object of the invention is to provide a thermal transfer image-receiving sheet which has a receiving layer on the front of a base sheet and a receiving layer or a resin layer which is not receptive to dye or ink on the back of the base sheet so that the sheet can receive images on both sides and/or the sheet is free from curling under influence of ambient humidity or temperature.

SUMMARY OF THE INVENTION

The invention provides an image-receiving sheet for recording with ink or dye which comprises a base sheet and a resin layer thereon comprising a powdery coating composition which contains a resin component as a dye- or ink-receiving layer. That is, the image-receiving sheet for recording of the invention is produced by dry-coating a powdery coating composition which contains a resin component on a base sheet by an electrostatic spraying process, and then heating, melting and fixing the powdery coating composition thereon to form a resin coating or film as a dye- or ink-receiving layer.

Thus, the invention further provides a process for producing an image-receiving sheet for recording with dye or ink which comprises dry-coating a powdery coating composition which contains a resin component on a base sheet by an electrostatic spraying process, and then heating, melting and fixing the powdery coating composition thereon to form a resin coating or film as a dye- or ink-receiving layer.

In particular, the invention provides a process for producing an image-receiving sheet, for example, an image-receiving paper, for recording with dye or ink which comprises dry-coating a powdery coating composition which contains a resin component on a long-sized continuous base sheet, for example, long-sized paper unrolled from a roll, by an electrostatic spraying process, and heating, melting and fixing the powdery coating composition thereon to form a resin coating or film as a dye- or ink-receiving layer.

The invention also provides an thermal transfer image-receiving sheet which has, on a base sheet, in particular, a base paper, a receiving layer comprising at least one resin which, when a thermal transfer sheet (an ink sheet) having a layer of dye or ink on a support is attached thereto under heat, can receive the dye or ink from the ink sheet, wherein the receiving layer has a thickness in the range of 1–100 μm, preferably in the range of 2–80 μm, and comprises a powdery coating composition which contains said at least one resin and has a mean particle size of 1–30 μm. The thermal transfer sheet which has the above-mentioned structure is useful especially when the base paper has unevenness or undulation at least 10 μm in height on the surface.

According to the invention, such a thermal transfer sheet as above is obtainable by dry-coating a powdery coating composition which contains said at least one resin receptive to the dye or ink from the ink sheet and has a mean particle size of 1–30 μm to form a layer of the composition having a thickness of 3–130 μm, preferably 5–90 μm, and then heating, melting and fixing the powdery coating composition thereon to form a resin coating or film as a dye- or ink-receiving layer having a thickness of 1–100 μm, preferably 2–80 μm.

Therefore, according to the invention, if a base paper used as a base sheet has unevenness or undulation at least 10 μm in height on the surface, a thermal transfer image-receiving paper which has good and uniform contact with an ink sheet and hence forms a high quality transfer image thereon is obtained by dry-coating a powdery coating composition which contains the said at least one resin and has a mean particle size of 1–30 μm to form a layer comprised of the powdery coating composition having a thickness of 3–130 μm, preferably 5–90 μm, and then heating, melting and fixing the powdery coating composition thereon to form a resin coating or film as a dye- or ink-receiving layer having a thickness of 1–100 μm, preferably 2–80 μm. This process is useful for the production of a thermal transfer image-receiving paper when a base paper used has unevenness or undulation at least 10 μm in height on the surface on which a receiving layer is formed.

As a further aspect of the invention, it further provides a thermal transfer image-receiving sheet which has, on a base sheet, a receiving layer comprising at least one resin which, when a thermal transfer sheet having a layer of dye or ink on a support is attached thereto under heat, can receive the dye or ink from the sheet, wherein the receiving layer comprises a resin coating or film formed of a powdery coating composition which contains said at least one resin and the resin coating has an arithmetic mean surface roughness Ra in the range of 0.1–4.0 and a ten point average surface roughness Rz in the range of 0.5–20.0, as measured according to the provisions of JIS B 0601-1994.

In addition to the above-mentioned, the invention further provides a two layer structure thermal transfer image-receiving sheet which has on a base sheet a receiving layer comprising a powdery coating composition and a releasing layer thereon. The invention still further provides a thermal transfer image-receiving sheet which has on the front of a base sheet a first receiving layer and a second receiving layer or a resin layer which is not receptive to the dye or ink from an ink sheet on the back of the base sheet.

Figure 1:
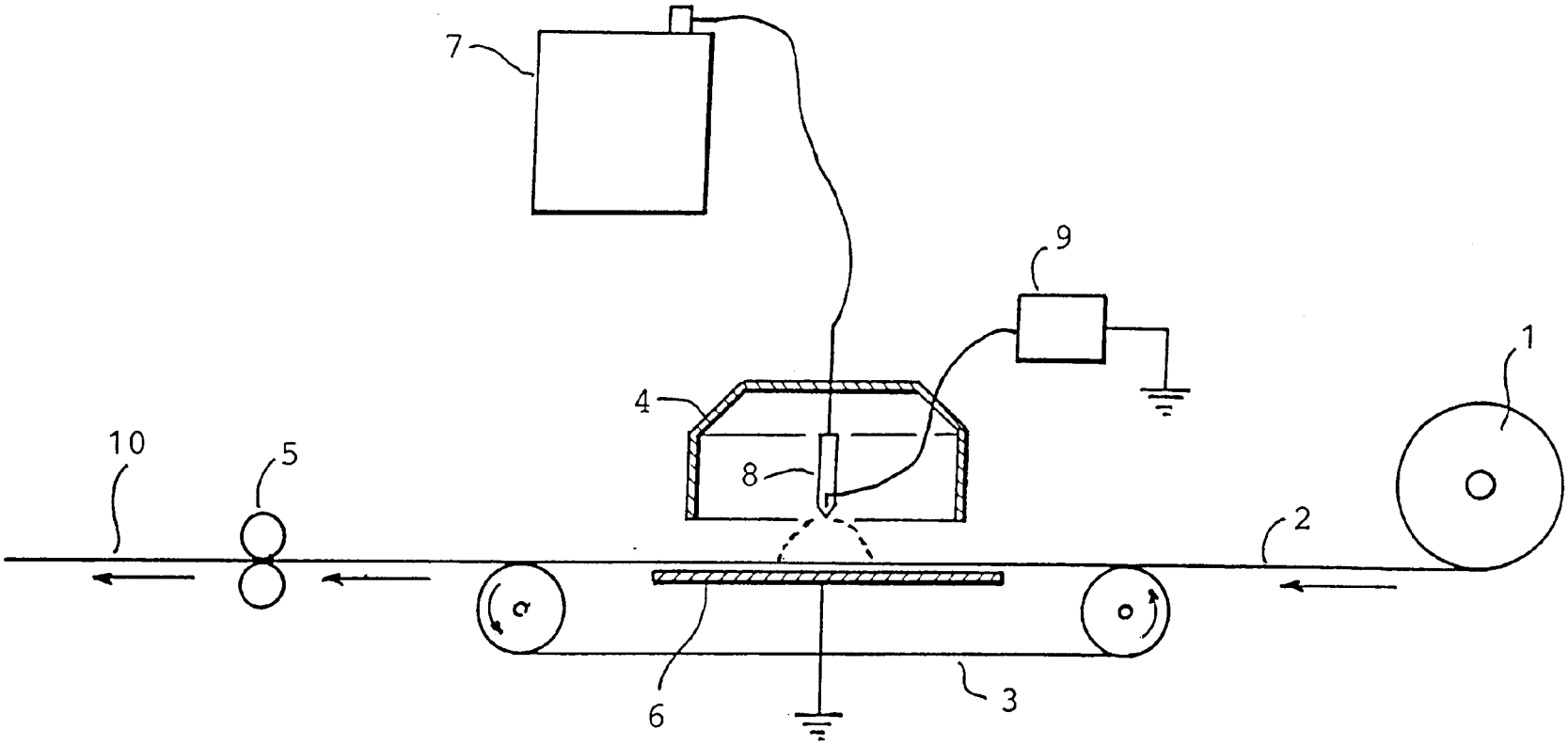
FIG. 1 is a view showing the constitution of devices for conducting preferred embodiments of the process of the invention.

DETAILED DESCRIPTION OF PREFERRED EMBODIMENTS OF THE INVENTION (Image-receiving Sheet Having a Receiving Layer comprising a Powdery Coating Composition on a Base Sheet and Production Thereof)

The thermal transfer image-receiving sheet as referred to herein is a sheet which has, on a base sheet, a receiving layer comprising at least one resin which, when a thermal transfer sheet (or an ink sheet) having a layer of dye or ink on a support is attached thereto under heat, can receive the dye or ink from the ink sheet, thereby making it possible to print or record an image on the thermal transfer image-receiving sheet.

The thermal transfer includes either of thermal transfer of sublimable dyes and thermally meltable inks as described hereinbefore.

The powdery coating composition used in the process of the invention comprises at least one resin. The resin acts as a binder resin for binding the other components constituting the composition into a powdery composition, while additionally acting to form a continuous film of a receiving layer on a base sheet and acting to receive an image-forming dye or ink as transferred from an ink sheet thereonto, thereby attaining transfer of the dye or ink onto the receiving layer to form an image thereon.

The resins include, for example, saturated polyester resins, polyamide resins, (meth)acrylic resins, polyurethane resins, polyvinyl alcohol resins, polyvinyl acetate resins, polyvinyl chloride resins, polyvinyl acetate resins, vinyl chloride-vinyl acetate copolymer resins, vinylidene chloride resins; styrenic resins such as polystyrene resins, styrene-acrylic copolymer resins, styrene-butadiene copolymer resins; as well as polyethylene resins, ethylene-vinyl acetate copolymer resins, cellulosic resins, and epoxy resins. These resins can be used in the composition either singly or as suitably combined.

Among these resins are particularly preferred saturated polyester resins or styrene-acrylic copolymer resins. These resins can be used singly or as a mixture to form a single layer or separately to form separate layers, when necessary.

The saturated polyester resin is a polymer obtained by polycondensation of a dibasic carboxylic acid and a dihydric alcohol. The dibasic carboxylic acid includes, for example, aliphatic dibasic carboxylic acids such as malonic acid, succinic acid, glutaric acid, adipic acid, azelaic acid, sebacic acid or hexahydrophthalic anhydride; or aromatic dibasic carboxylic acids such as phthalic anhydride, phthalic acid, terephthalic acid or isophthalic acid. However, the divalent carboxylic acid usable is not limited to those exemplified above. If necessary, tribasic or polybasic (more than tribasic) carboxylic acids such as trimellitic acid anhydride or pyromellitic acid anhydride may be used together with the dibasic carboxylic acid.

The dihydric alcohol includes, for example, ethylene glycol, propylene glycol, butylene glycol, hexanediol, neopentyl glycol, diethylene glycol, dipropylene glycol or hydrogenated bisphenol A. However, the dihydric alcohol usable is not limited to those exemplified above. If necessary, trihydric or polyhydric (more than trihydric) alcohol such as glycerine, trimethylolpropane, diglycerine, pentaerythritol or sorbitol mat be used together with the dihydric alcohol.

Commercially available products of saturated polyester resins can be used favorably. They include, for example, Bailon 103, 200, 290, 600 (all available from Toyo Boseki H. H.); RA-1038C (available from Arakawa Chemical Co.); TP-220, 235 (both available from Nippon Synthetic Chemical Industry Co.); Diaculon ER-101, ER-501, FC-172, FC-714 (all available from Mitsubishi Rayon Co.); and NE-382, 1110, 2155 (all available from Kao Corp.).

Those of usable vinyl chloride-vinyl acetate copolymer resins include, for example, Denka Vinyl 1000D, 1000MT2, 1000MT3, 1000LK2, 1000ALK (all available from Denki Kagaku Kogyo K. K.); UCRA-VYHD, UCRA-VYLF (both available from Union Carbide. Co.); and Eslec C (available from Sekisui Chemical Industry Co.).

The styrene-acrylic copolymer resins are copolymers of styrene and (meth)acrylic esters. The (meth)acrylic ester includes, for instance, ethyl acrylate, butyl acrylate, methyl methacrylate, ethyl methacrylate, butyl methacrylate, 2-ethylhexyl methacrylate, 2-hydroxyethyl acrylate, dimethylaminoethyl methacrylate or diethylaminoethyl methacrylate. Among these styrene-acrylic copolymer resins, for example, styrene-butyl acrylate copolymers, styrene-butyl methacrylate copolymers, styrene-methyl methacrylate copolymers, or a mixture of two or more or these are especially preferred.

Commercially available products of styrene-acrylic copolymer resins can be used favorably. They include, for example, Himer UNi-3000, TB-1800, TBH-1500 (all available from Sanyo Chemical Industry Co.); and CPR-100, 600B, 200, 300, XPA4799, 4800 (all available from Mitsui Toatsu Chemical Co.).

The powdery coating composition for use in the invention preferably contains a white colorant or a colorless filler. The white colorant or colorless filler includes, for example, zinc flower, titanium oxide, tin oxide, antimony white, zinc sulfide, barium carbonate, clay, silica, white carbon, talc, alumina or barite. Titanium oxide is preferred as the white colorant; it is incorporated in the composition in order to whiten a base sheet, for example, common paper, that is used. In general, the white colorant or colorless filler may be contained in the powdery coating composition usually in an amount of from 0.5–15% by weight, preferably from 1–10% by weight.

The powdery coating composition used in the invention may contain an offset inhibitor so that the composition does not offsets when it is fixed on a base sheet. As the offset inhibitor, in general, various waxes having a melting point of from 50–150° C. are preferred. Concretely mentioned are paraffin wax, polyolefin waxes, such as polyethylene or polypropylene wax, as well as metal salts of fatty acids, esters of fatty acids, higher fatty acids, or higher alcohols. The offset inhibitor may be contained usually in an amount of 0.1–20% by weight, preferably 0.5–10% by weight based on the powdery coating composition.

In order to improve the fluidity of the powdery coating composition, a fluidity-improving agent, such as finely divided powder of hydrophobic silica or alumina, may be added to the composition, if desired. The incorporation of fluidity-improving agent in the powdery coating composition improves fluidity of the composition when it is dry-coated on a base sheet by an electrostatic spraying process.

The finely divided powder of hydrophobic silica or alumina is also useful to improve releasability of thermal transfer image-receiving sheet from an ink sheet. That is, the incorporation of fluidity-improving agent in the powdery coating composition prevents the thermal transfer image-receiving sheet from thermal fusion to an ink sheet when heated for thermal transferring, thereby improving releasability of the thermal transfer image-receiving sheet from an ink sheet. As the finely divided powder of hydrophobic silica or alumina useful to improve the releasability of the thermal transfer image-receiving sheet from an ink sheet, commercially available products are suitably used, such as RA-200H (finely divided powder of hydrophobic silica), Aluminum Oxide C (finely divided powder of alumina) (both available from Nippon Aerosil K.K.). The finely divided powder of hydrophobic silica or alumina may be contained usually in an amount of 10 parts by weight or less, preferably from 0.1 to 5 parts by weight, more preferably from 0.2 to 2 parts by weight, relative to 100 parts by weight of the composition.

It is preferred that the powdery coating composition contains, in addition to the above-mentioned resin component, a cured product derived from a reaction-curable silicone oil having reactive functional groups therein so that the thermal transfer image-receiving sheet secures the releasability from an ink sheet especially when the thermal transfer of image is carried out from the ink sheet to the thermal transfer image-receiving sheet. The cured product derived from a reaction-curable silicone oil may be a cured product of at least two reaction-curable silicone oils having functional groups capable of mutually reacting with each other.

However, as fully described hereinafter, the cured product may be such that it is formed by a reaction of a silicone oil having a functional group therein and a resin component having a functional group therein, such as a carboxyl or hydroxyl groups.

The reaction-curable silicone oil is, for example, a polysiloxane, usually a dimethylpolysiloxane, which has reactive groups such as amino, epoxy, carboxyl, carbinol, methacrylic, mercapto or phenol group, as pending groups or at the molecular terminals. Various products of such reaction-curable oils are commercially available. Such commercially available products can be suitably used in consideration of the reactivity of the functional groups therein in the invention.

For example, as commercially available products of amino-modified silicone oils, there are mentioned KF-393, 861, 864, X-22-161A (all products of Shin-etsu Chemical Industry Co.); as those of epoxy-modified silicone oils, there are mentioned KF-101, 102, 103, 105, X-22-163C, X-22-169C (all products of Shin-etsu Chemical Industry Co.); as those of carboxyl-modified silicone oils, there are mentioned X-22-162A, X-22-3710, X-22-162C, X-22-3701E (all products of Shin-etsu Chemical Industry Co.); and as those of carbinol-modified silicone oil, there are mentioned X-22-162AS, KF-6001 (both products of Shin-etsu Chemical Industry Co.). For these silicone oils, their properties and methods for producing them are described in detail, for example, in "Silicone Handbook" (published by Nikkan Kogyo Newspaper Co., Aug. 31, 1990).

In the case the powdery coating composition should contain a cured product of at least two reaction-curable silicone oils having functional groups capable of mutually reacting with each other, as a preferred combination of the reaction-curable silicone oils among those as mentioned above, preferably used in the invention are combinations of modified silicone oils with amino or hydroxyl groups, and modified silicone oils with epoxy, isocyanato or carboxyl groups. A combination of an amino-modified silicone oil and an epoxy-modified silicone oil is especially preferred. Such two reaction-curable silicone oils are used in such a manner that the functional groups capable of mutually reacting with each other in these may be equivalent.

In turn, in the case the powdery coating composition should contain a cured product formed by a reaction of a silicone oil having a functional group therein and a resin component having a functional group therein in a powdery coating composition, such as a carboxyl or hydroxyl group, there is preferably used, for example, an epoxy-modified silicone oil.

The powdery coating composition may contain such a cured product as mentioned above which is derived from the reaction-curable silicone oils in an amount from 0.5 to 12% by weight, preferably in an amount from 0.5 to 10% by weight, in terms of the amount of the silicone oils, based on the powdery coating composition. When the amount of the cured product in the powdery coating composition is smaller than 0.5% by weight, the releasability of the thermal transfer image-receiving sheet is unsatisfactory so that an ink sheet is fused onto the thermal transfer image-receiving sheet during thermal transferring therebetween and high quality images cannot be formed on the image-receiving sheet. On the other hand, when the amount of the cured product in the composition is larger than 12% by weight, the density of transfer images formed is poor since the amount of the cured product is too much.

The cured product derived from the reaction-curable silicone oils may be replaced by a powdery silicone-modified acrylic resin which is prepared by modifying an acrylic resin by a reaction-curable silicone oil. As such a silicone-modified acrylic resin, commercially available products such as X-22-8004 or X-22-2110 (either product of Shin-etsu Chemical Industry Co.) are suitably used.

It is especially preferred that the thermal transfer image-receiving sheet of the invention comprises a receiving layer which is formed of a powdery coating composition which contains a saturated polyester resin as at least one of resins used therein, and a cured product of the saturated polyester resin and a reaction-curable silicone oil such as an epoxy-modified reaction-curable silicone oil, as mentioned hereinbefore, so that the resulting thermal transfer image-receiving sheet has an excellent releasability from an ink sheet.

The powdery coating composition used in the invention can be obtained by preparing a mixture comprising the resin component as mentioned hereinbefore, and if necessary, colorants, fillers, reaction-curable silicone oils, silicone-modified acrylic resins or offset inhibitors, and melt-kneading under heat the mixture usually at about 100–200° C., preferably at about 130–180° C., for several minutes, usually for about 3–5 minutes. If the mixture contains reaction-curable silicone oils, they react with each other or with the resin component during the kneading and form a cured product. However, the heating temperature and time are not specifically limited, and the heating of the mixture can be conducted under any conditions under which the resin component, reaction-curable silicone oils and the other components such as colorants, fillers or offset inhibitors are uniformly mixed together, while the reaction-curable silicone oils are mutually reacted with each other or reacted with the resin component to form a cured product.

As mentioned above, the mixture is melt-kneaded, cooled, and then ground and classified to give particles having a suitable mean particle size, thereby providing a powdery coating composition for use to form a receiving layer to receive ink or dye from an ink sheet thereonto on a base sheet. The powdery coating composition usually has a mean particle size of from 1 $\mu$m to 30 $\mu$m, preferably from 2 $\mu$m to 25 m, and most preferably from 5 $\mu$m to 20 $\mu$m.

According to the invention, an image-receiving sheet is obtained by dry-coating the powdery coating composition as mentioned above by an electrostatic process on a base sheet, and heating, melting and fixing the composition thereon to form a resin coating or film comprising the composition as a dye- or ink-receiving layer. The dye- or ink-receiving layer has a thickness usually of from 1 $\mu$m to 100 $\mu$m, preferably from 2 $\mu$m to 80 $\mu$m, and most preferably from 5 $\mu$m to 50 $\mu$m.

The thermal transfer image-receiving sheet for recording of the invention has a receiving layer which is comprised of a resin coating or film and has a surface of which arithmetic mean roughness Ra is in the range of 0.1–4.0, preferably in the range of 0.5–4.0 and ten point mean roughness Rz is in the range of 0.5–20.0, preferably in the range of 3.0–20.0, as measured in accordance with JIS B 0601-1994. The thermal transfer image-receiving sheet of the invention, therefore, has a moderate unevenness or undulation on the surface.

The thermal transfer image-receiving sheet of the invention thus has a so-called matted surface and forms a thermal transfer image having a feeling of quality. Besides, a common writing instrument such as a pencil, ball-point pen or fountain pen writes well on the sheet.

When the sheet has a surface roughness smaller than the above-mentioned, the surface is close to that of the conventional thermal transfer image-receiving sheets and has gloss. On the other hand, when the sheet has a surface roughness larger than the above-mentioned, the surface is excessively uneven or undulating so that when an ink sheet is attached under heat to the thermal transfer image-receiving sheet to transfer the dye or ink on the ink sheet to the thermal transfer image-receiving sheet, the resulting image is of inferior quality on account of lack of uniform contact between the sheets.

The base sheet may be any of paper, synthetic paper and synthetic resin sheets. Paper may be common paper made of ordinary cellulose fibers, including high quality paper and coated paper as well as common paper. Common paper as referred to herein includes, for example, ordinary PPC copying paper, PPC copying paper as calendered to have improved surface smoothness, surface-treated paper for thermal transfer-type word processors, and coated paper, among others. The synthetic resin sheets include, for example, sheets of polyesters, polyvinyl chloride, polyethylene, polypropylene, polyethylene terephthalate, polycarbonates, polyamides or the like. The synthetic paper be such that it is produced, for example, by sheeting a mixture comprising a resin such as polyolefin resins or any other synthetic resins and any desired inorganic filler and others, through extrusion.

It is advantageous to use paper as the base sheet since the use of paper permits to produce the image-receiving sheet inexpensively. However, as set forth hereinbefore, paper usually has an uneven or undulant surface so that when a receiving layer is formed on such a surface, it follows the surface, with the results that the resultant image-receiving sheet has a bad contact with an ink sheet, thereby failing to give a clear transferred image thereon.

According to the invention, however, a high quality thermal transfer image-receiving sheet can be produced even if paper which has uneven or undulating surface at least of 10 μm in height, in particular, from 10 μm to 100 μm in height.

That is, the thermal transfer image-receiving sheet of the invention comprises a base paper which has an uneven or undulating surface at least of 10 μm in height and a coating or film 1–100 μm, preferably 2–80 μm thick which comprises a powdery coating composition which contains a resin component and has a mean particle size from 1 μm to 30 μm.

The thermal transfer image-receiving sheet mentioned above is obtainable according to the invention by dry-coating such a powdery coating composition as mentioned hereinbefore which contains a resin component and have a mean particle size of 1–30 μm to form a green layer of the powdery coating composition 3–130 μm, preferably 5–90 μm thick on a base paper (as a base sheet), and then heating, melting and fixing the composition thereon to form a resin coating or film 1–100 μm, preferably 2–80 μm thick as a dye- or ink-receiving layer. The green layer of the coating composition can be formed so as to have a desired thickness by adjusting the number of layers of the coating composition used according to the mean particle size thereof. Usually the green layers are formed in from two to ten layers.

As described above, even if a base paper which has a uneven or undulating surface at least of 10 μm in height (vertical distance between the highest portions and the lowest portions of the surface of the base sheet), in particular, from 10 μm to 100 μm in height, the unevenness or undulation of the surface can be offset or compensated, or reduced or decreased by forming a receiving layer as mentioned above on the base paper. Consequently, when an ink sheet is attached to the thus obtained thermal transfer image-receiving sheet under heat, an image is transferred to the image-receiving sheet to form a clear image with no defects on account of uniform contact between the ink sheet and the image-receiving sheet.

When the receiving layer has a thickness less than 1 μm, it cannot offset or compensate, or reduce or decrease the unevenness or undulation of the surface of base paper. As results, such a receiving layer follows the surface, and the receiving layer has also an uneven or undulating surface. Accordingly, when an ink sheet is attached to the thus obtained thermal transfer image-receiving sheet under heat, an image is transferred incompletely to the image-receiving sheet to give an image with defects on account of lack of uniform contact between the ink sheet and the image-receiving sheet.

It is particularly preferred that the receiving layer has a thickness of not less than 2 μm. On the contrary, if the receiving layer more than 100 μm thick is formed, additional desirable effects cannot be obtained according to the increased thickness of the layer. In addition, it is undesirable from the economical standpoint. It is preferred that the receiving layer has a thickness of 2–80 μm, most preferably in the range of 5–20 μm.

The receiving layer may be formed entirely on a base sheet, or if desired, partly as required.

(Thermal Transfer-Image-receiving Sheet Having a Receiving Layer or a Second Resin Layer on the Back as well as on the Front of Base Sheet)

According to the invention, since a receiving layer is formed on a base sheet by dry-coating a powdery coating composition on the base sheet, and heating, melting and fixed the powdery coating composition, a second receiving layer can be readily formed on the back of the base sheet, if paper is used as the base sheet, unlike the conventional processes wherein a receiving layer is formed by wet-coating.

The image-receiving sheet which has receiving layers on both sides of base sheet as mentioned above permits the thermal transfer recording on both sides of the image-receiving sheet. Moreover, the image-receiving sheet has the same layer structure on both sides so that it is free from curling under influence of ambient temperature or humidity conditions.

A simple resin layer (a second resin layer) which cannot receive ink or dye from an ink sheet may be formed on the back of a base sheet in place of a receiving layer.

The resin for the second resin layer is not specifically limited, however, the resin may be, for example, the same resins as those incorporated in the powdery coating composition mentioned hereinbefore. Thus, the resin may be saturated polyester resins or styrene-acrylic resins. Polyethylene or polypropylene resins may also be used for the second resin layer.

When the second resin layer is formed, a resin is used advantageously in the form of a powdery coating composition, as in the case in which a receiving layer is so formed. More specifically, a powdery coating composition is dry-coated on the back of a base sheet by an electrostatic spraying process, and is then heated, melted and fixed thereon, thereby forming the second resin layer. However, the process for forming the second resin layer is not limited to the dry-coating of powdery coating composition. By way of example, a solution of a resin may be wet-coated on the back of base sheet and dried. Alternatively, a film of resin may be glued to the back of base sheet with an adhesive or may be stuck with a press. As a further alternative, a resin may be melted and coated on the back of base sheet to form a film as the second resin layer.

The second resin layer is usually in the range from 1 $\mu$m to 80 $\mu$m thick, preferably 2 $\mu$m to 50 $\mu$m thick, although depending on the resin used for the receiving layer on the front of the base sheet and its thickness.

One embodiment of the thermal transfer image-receiving sheet of the invention thus has the first resin layer as a receiving layer and the second resin layer on the back of a base sheet. Accordingly, the resin layers formed on both of front and back of the base sheet are influenced by ambient humidity or temperature substantially to the same extent to be swollen or shrank, and hence the image-receiving sheet does not curl or is not curved under influence of ambient humidity or temperature. This means that the image-receiving sheet of the invention does not curl if it is heated rapidly for transferring of dye or ink from an ink sheet. Besides, when the image-receiving sheet is so prepared as to have a receiving layer on either side of base sheet, the sheet can receive thermal transfer images on both sides.

From the standpoint of production of the thermal transfer image-receiving sheet as mentioned above, the second resin sheet can be easily formed on the back of the base sheet by the use of a powdery coating composition, in particular, if paper is used as a base sheet, being different from the conventional processes wherein a resin layer is formed by a wet-coating process.

(Thermal Transfer Image-receiving Sheet Having a Readily Releasable Receiving Layer)

According to the invention, there is further provided a thermal transfer image-receiving sheet which has only a single receiving layer on a base sheet and yet has excellent releasability from an ink sheet. This thermal transfer image-receiving sheet of the invention has on a base sheet a receiving layer formed from a powdery coating composition which comprises a resin component and a cured product formed by the reaction of the resin component and a reaction-curable silicone oil incorporated in the powdery coating composition. In particular, it is preferred that the powdery coating composition contains at least a saturated polyester resin as a resin component so that it reacts with the reaction-curable silicone oil to form a cured product in the receiving layer as a releasing agent when the receiving layer is formed from the powdery coating composition.

Preferably the thermal transfer image-receiving sheet mentioned above is produced by dry-coating a powdery coating composition on a base sheet to form a resin coating or film thereon wherein the powdery coating composition comprises a resin component in an amount of 70–95% by weight, a colorant, and a cured product of a reaction-curable silicone oil in an amount of 0.5–12% by weight in terms of the amount of the silicone oil. The resin component comprises from 50 to 90% by weight of a saturated polyester resin having an acid value of from 1.0 to 20 mg KOH/g and a glass transition point of from 50 to 70° C. and from 10 to 50% by weight of a styrene-acrylic copolymer resin. The cured product is such that it is formed by the reaction of the polyester resin having carboxyl and/or hydroxyl groups therein and the reaction-curable silicone oil having a functional group therein reactive to the carboxyl and/or hydroxyl groups of the polyester resin.

When a saturated polyester resin with no acid value is used herein, the thermal transfer of dye onto the thermal transfer image-receiving sheet is unsatisfactory, and a high density transfer image cannot be formed on the sheet. However, when a saturated polyester resin having a too high acid value is used, an ink sheet is fused to the thermal transfer image-receiving sheet when heated for thermal transferring, with the result that the formation itself of transfer image on the image-receiving sheet cannot be attained. When a saturated polyester resin having a too low glass transition point is used, an ink sheet is also fused to the thermal transfer image-receiving sheet when heated for thermal transferring, with the result that the formation itself of transfer images on the image-receiving sheet cannot be attained.

Of the resin component in a powdery coating composition, a saturated polyester resin is highly acceptable of dye or ink from an ink sheet being heated. On the other hand, a cured product formed of reaction-curable silicone oil and a saturated polyester resin acts to make the thermal transfer image-receiving sheet releasable from an ink sheet after the completion of thermal transference of dye or ink from the ink sheet to the image-receiving sheet. Accordingly, in order to enhance the releasability of the image-receiving sheet from an ink sheet, the amount of the reaction-curable silicone oil in the powdery coating composition might be increased. However, if too much amount of such an oil is incorporated in the composition, the density of the image transferred onto the image-receiving sheet is greatly reduced. According to the invention, therefore, the coating composition shall contain, as the resin component, a resin mixture comprising from 50 to 90% by weight of a saturated polyester resin such as that mentioned hereinabove and from 10 to 50% by weight of a styrene-acrylic copolymer resin such as that mentioned hereinabove so that a high density image is formed on the image-receiving sheet while increasing the releasability of the sheet, due to the action of the saturated polyester resin.

When the saturated polyester resin content of the resin component is higher than 90% by weight, an ink sheet is often fused to the thermal transfer image-receiving sheet during thermal transferring therebetween though the images transferred onto the image-receiving sheet may have relatively high density. On the other hand, when the saturated polyester resin content of the resin component is lower than 50% by weight, or that is, when the styrene-acrylic copolymer resin content thereof is higher than 50% by weight, the image density obtained is unsatisfactory though the releasability of the image-receiving sheet is high.

On the other hand, when the amount of the cured product derived from the reaction-curable silicone oil in the composition is smaller than 0.5% by weight in terms of the reaction-curable silicone oil, the releasability oft he thermal transfer image-receiving sheet is unsatisfactory so that an ink sheet is fused onto the thermal transfer image-receiving sheet during thermal transferring therebetween and high quality images cannot be formed on the image-receiving sheet. However, when the amount of the cured product in the composition is larger than 12% by weight, the density of transfer images formed is poor since the amount of the cured product is too much.

According to the invention, as a reaction-curable silicone oil which has a functional group capable of reacting with the carboxyl and/or hydroxyl groups of the saturated polyester resin, an epoxy group-containing reaction-curable silicone oil (that is, an epoxy-modified reaction-curable silicone oil) is preferably used. An epoxy-modified reaction-curable silicone oil which has an epoxy equivalent of 100–4000 g/mol is particularly preferred since a cross-linking reaction between such a silicone oil and the saturated polyester resin takes place efficiently to readily form a cured product when a powdery coating composition is prepared, as described hereinafter, thereby making the resulting thermal transfer image-receiving sheet highly releasable from an ink sheet. When a silicone oil having an epoxy equivalent of less than 100 g/mol is used, a sufficient amount of cured product is not formed when a powdery coating composition is prepared.

The thermal transfer image-receiving sheet mentioned above has only a single receiving layer on a base sheet and yet there takes place neither thermal fusion onto an ink sheet nor separation of dye or ink from the receiving layer of the thermal transfer image-receiving sheet after the completion of transferring of dye or ink from the ink sheet. Moreover, the thermal transfer image-receiving sheet does not deteriorate if it is stored over a long time. For example, it does not accompanied by undesirable yellowing over a long term storage.

(Two-layer Structure Thermal Transfer Image-receiving Sheet Having a Releasing Layer on a Receiving Layer)

The thermal transfer image-receiving sheets as mentioned above are all prepared by dry-coating a powdery coating composition which contains a resin component on a base sheet, and is then heated, melted and fixed thereon to form a single layer of dye- or ink-receiving layer. However, as one of the aspects of the invention, there is provided a two-layer structure thermal transfer image-receiving sheet which has, on a receiving layer, a releasing layer highly releasable from an ink sheet.

A first of such two-layer structure thermal transfer image-receiving sheets of the invention comprises a first resin layer as a dye- or ink-receiving layer on a base sheet and a second resin layer thereon as a releasing layer from an ink sheet. The first resin layer is formed of a first powdery coating composition which contains a first resin while the second resin layer is formed of a second powdery coating composition which contains a second resin releasable from an ink sheet.

The first resin to form a receiving layer is preferably a saturated polyester resin, as stated hereinabove. The second resin may be suitably selected from the resins mentioned hereinbefore, however, a styrene-acrylic copolymer resin or a silicone resin such as methyl silicone resins or methylphenyl silicone resins are preferred. However, if necessary, otherwise modified silicone resins may be used.

For forming a releasing layer as the second resin layer on a receiving layer as the first resin layer, a second powdery coating composition which contains the second resin therein is prepared and it is dry-coated, for example, by an electrostatic spraying process, on the receiving layer, in the same manner as the receiving layer is formed, followed by heating, melting and fixing thereon. The second resin layer usually has a thickness of 1–20 $\mu$m, preferably 1–10 $\mu$m, and most preferably 1–5 $\mu$m, although depending on the resin component and thickness of the receiving layer.

As another embodiment of the invention, a releasing layer may be formed of inorganic or organic minute particles. The inorganic minute particles include, for example, those of silica, alumina or titanium dioxide, while the organic minute particles include, for example, those of polymethyl methacrylate or polystyrene. The minute particles have a mean particle size of not more than 5 $\mu$m, preferably of not more than 1 $\mu$m. The lower limit of mean particle size of the minute particles is not specifically limited, however, it is usually about 1 nm. As the organic minute particles, polymethyl methacrylate particles having a mean particle size of about 0.5 $\mu$m are commercially available. In turn, as the inorganic minute particles, for instance, silica particles having a mean particle size in the range of 5–30 nm are commercially available. These commercially available products are suitably used in the invention.

The minute particles are dry-coated on a receiving layer by a spraying process including an electrostatic spraying process, and are then heated under pressure to fix the particles on the receiving layer. When a releasing layer is formed of inorganic or organic minute particles in this manner, the particles are in part buried and fixed in the receiving layer, although depending upon the size of the particles, thereby forming a releasing layer. There is no need of forming a thick and continuous layer of the particles to form an effective releasing layer. Accordingly, the amount of the particles used are suitably determined according to the releasing effect of the particles used. However, the releasing layer may have a substantial thickness, if desired.

The thermal transfer image-receiving sheet as stated above can be prepared by a dry-coating process, without resort to multi-step wet-coating.

Nevertheless, if necessary, a wet-coating process may be employed to form a releasing layer on a receiving layer. From this standpoint, there is provided a second of the two-layer structure thermal transfer image-receiving sheets of the invention which comprises a first resin layer as a dye- or ink-receiving layer on a base sheet and a second resin layer thereon as a releasing layer from an ink sheet, wherein the second resin layer is formed by wet-coating a solution of a second resin in a solvent, and then drying, if necessary, under heat. The second resin layer thus formed usually has a thickness of 1–20 $\mu$m, preferably 1–10 $\mu$m, and most preferably 1–5 $\mu$m, although depending on the resin component and thickness of the receiving layer.

A releasing layer can also be formed by coating a reaction-curable silicone oil on a receiving layer and then drying, if necessary, under heating. That is, the reaction-curable silicone oil is coated on a receiving layer and dried, if necessary, under heat, to form a cured product by the reaction at the surface of the receiving layer with each other or with the resin component in the receiving layer, as stated hereinbefore, while the silicone oil also reacts at the surface thereof with moisture in air to form a dried product, thus forming a releasing layer as a dried thin film.

For instance, when the receiving layer is formed of saturated polyester resin and an epoxy-modified silicone oil is coated on the receiving layer as the reaction-curable silicone oil, the silicone oil reacts with the carboxyls and/or hydroxyl groups of the saturated polyester resin on the surface of the receiving layer to form a cured product while the silicone oil reacts with moisture in air at the surface of the coating layer of the silicone oil to form a dried thin film.

Because of combination of the receiving layer comprised of a powdery coating composition and a releasing layer thus formed on the receiving layer, both of the first and the second two-layer structure thermal transfer image-receiving sheets of the invention can form a high quality thermally transferred image which stands comparison with the conventional image-receiving sheet specially prepared by multi-step wet-coating processes.

(Electrostatic Spraying of Powdery Coating Composition onto Base Sheet)

According to the invention, an electrostatic spraying process is preferably employed to form a receiving layer on a base sheet by use of a powdery coating composition. The electrostatic spraying process is a process which is per se already known. However, in more detail, by way of example, on the one hand, a finely divided powdery coating composition is transported to the top of a spraying gun with air while a high negative voltage (e.g., from −50 kV to −90 kV) is applied to a needle electrode mounted at the top of the spraying gun to negatively charge the powdery coating composition, and on the other hand, an earthed (or grounded) electrode is placed along the back of a base sheet to generate an electric field between the spraying gun and the earthed electrode, and the negatively charged finely divided powdery coating composition is carried to the base sheet by making use of the electric field and adheres onto the surface of the base sheet.

FIG. 1 shows a preferred example of the constitution of devices for the production of thermal transfer image-receiving sheet of the invention. A long-size continuous base sheet such as base paper 2 unrolled from a roll 1 is guided by a transporting belt 3 into a booth 4 where, as mentioned hereinafter, a powdery coating composition is dry-coated thereonto by an electrostatic spraying process. The base paper is then guided to a fixing device 5 comprising a couple of rolls, and then rolled again, or cut to a desired length. The transporting belt 3 has an earthed electrode (accordingly, a positive electrode) 6 so that it extends along the back of the base paper which the transporting belt carries. The finely divided powdery coating composition is transported from a reservoir 7 to a spraying gun 8 with compressed air while a high negative voltage is applied to a needle electrode (not shown) mounted at the top of a spraying gun through a direct current power source 9 to negatively charge the powdery composition.

In this manner, an electric field is generated between the spraying gun and the earthed electrode placed along the back of the base paper so that the powder coating composition is transported to the base paper and adheres onto the base paper electrostatically. The base paper is then guided to the fixing device 5 where it is heated, melted and fixed on the base paper, thereby forming a resin coating or film as a dye- or ink-receiving layer and providing a thermal transfer image-receiving sheet 10 of the invention.

By using the electrostatic spraying process as mentioned above, the receiving layer can be formed on the entire surface of base sheet or partly as desired.

INDUSTRIAL APPLICABILITY

As set forth above, the image-receiving sheet for recording with dye or ink of the invention comprises a resin layer formed of a powdery coating composition which contains a resin component on a base sheet as a dye- or ink-receiving layer. The image-receiving sheet can be produced according to the invention by dry-coating the powdery coating composition on a base sheet by an electrostatic spraying process, heating, melting and fixing the powdery composition on the base sheet to form a resin layer as a dye- or ink-receiving layer. Accordingly, the image-receiving sheet of the invention can be produced inexpensively in a simple manner, being different from the conventional ones having a plurality of resin layers each formed by a wet-coating process.

EXAMPLES

The invention will now be described with reference to the following examples, which, however, are not intended to restrict the scope of the invention. The parts and percents are by weight unless otherwise specified.

A. Image-receiving Sheets for Recording Having a Receiving Layer Comprising a Powdery Coating Composition on a Base Sheet Example 1

| (Production of Powdery Coating Composition) | |
|---|---|
| Saturated Polyester Resin (NE-382, product of Kao Corp.) | 44% |
| Styrene-acrylic Copolymer Resin (TB-1804, product of Sanyo Chemical Co.) | 44% |
| Offset Inhibitor (Wax Biscol 330P, product of Sanyo Chemical Co.) | 4% |
| Titanium Oxide | 5% |
| Amino-modified Silicone Oil (KF-861, product of Shin-etsu Chemical Industry Co.) | 1.5% |
| Epoxy-modified Silicone Oil (KF-102, product of Shin-etsu Chemical Industry Co.) | 1.5% |

A raw material comprising the components above was mixed in a mixer, and then melt-kneaded in a double-screw melt-kneaded at a temperature of 150–160° C. for about 3–5 minutes. After having been cooled, the resulting mixture was ground and classified to provide a white powdery coating composition having a mean particle size of 10 $\mu$m. 100 parts of this powdery coating composition was mixed with 0.5 parts of hydrophobic silica (RA-200H, product of Nippon Aerosil Co.) to prepare a white powdery coating composition for use in dry coating in an electrostatic spraying process.

(Production of Image-receiving Sheet for Recording)

Using a commercially-available electrostatic spraying device, the white powdery coating composition prepared hereinabove was applied onto commercially available common paper to make the composition adhered onto the entire surface of the paper, thereby producing white image-receiving paper.

(Thermal Transfer of Sublimable Dyes onto Image-receiving Paper)

Using a high-speed printer for a sublimation thermal transfer process, an ink sheet mentioned below was attached to the thermal transfer image-receiving paper prepared hereinabove, with the surface of the dye layer of the former facing the receiving layer of the latter, and the ink sheet was heated with a thermal head thereby making the dyes transferred onto the receiving layer of the thermal transfer image-receiving paper. In the transfer image obtained herein, the optical densities (of yellow, magenta and cyan) were measured; and the releasability of the ink sheet from the image-transferred paper was observed. The results are shown in Table 1.

Transference Conditions Employed Herein for the High-speed Printer for Sublimation Thermal Transfer Process:

Thermal Head: KGT-219-12MPL2 (produced by Kyosera Co.)

Driving Voltage: 17 V

Line Speed: 4 ms

Sublimable Dyes in Ink Sheet:

Sublimable Yellow Dye: styryl-type yellow dye

Sublimable Magenta Dye: anthraquinone-type magenta dye

Sublimable Cyan Dye: indaniline-type cyan dye

Test Method

For the optical densities of the transfer image formed, the reflection densities were measured with a densitometer (PDA-60, produced by Konica Co.).

To determine the releasability of the ink sheet from the image-transferred paper, the following four matters were checked from which the releasability was evaluated in three ranks (Standard I):

(1) Possibility of high-speed printing.

(2) Presence or absence of white spots in the transfer image caused by the peeling of the receiving layer.

(3) Presence or absence of adhesion of the ink sheet to the receiving layer.

(4) Noise occurred when the ink sheet was peeled from the image-transferred paper.

A: Small noise occurred; neither peeling of the receiving layer nor adhesion of the ink sheet occurred.

B: Large noise occurred; a little peeling of the receiving layer and a little adhesion of the ink sheet occurred.

C: High-speed printing was impossible; great peeling of the receiving layer and great adhesion of the ink sheet occurred.

Example 2

(Thermal Transfer of Thermally Meltable Ink onto Image-receiving Paper)

Using a printer for a thermal melt transfer process (G370-70, produced by Mitsubishi Electric K.K.), an ink sheet mentioned below was attached to the image-receiving paper prepared in Example 1, and the ink sheet was heated with a thermal head thereby making the ink transferred onto the receiving layer of the image-receiving paper. In the transfer image obtained herein, the optical densities (of yellow, magenta and cyan) were measured, and the releasability of the ink sheet from the image-transferred paper was observed. The results are shown in Table 1.

Test Method

The optical densities of the transfer image formed were measured in the same manner as in Example 1 and the releasability of the ink sheet from the image-transferred paper was evaluated in three ranks in the same manner as in Example 1 according to Standard I.

Example 3

(Printing with Solid Ink Jet Ink)

Using a commercially available printer for a solid ink jet process (SJ01APS2, produced by Hitachi Koki K.K.), an image was printed on the image-receiving paper prepared in Example 1. In the image formed thereon, the optical densities (of yellow, magenta and cyan) were measured, and the spreadability of the ink was observed. The results are shown in Table 1.

Test Method

The optical densities of the image formed were measured in the same manner as in Example 1. To determine the spreadability of the ink, ink absorbency, resolving power and drying of the ink were checked from which the spreadability of the ink was evaluated in three ranks as follows (Standard II):

A: The size of one dot on the sheet is 1.0–1.5 times as large as the prescribed value.

B: The size of one dot on the sheet is 1.5–2.0 times as large as the prescribed value.

C: The ink was repelled on the sheet to fail to form an image, or the size of one dot on the sheet is more than twice as large as the prescribed value.

Example 4

(Letterpress Printing)

Using a commercially available letterpress machine (Heidelberg cylinder machine), an image was printed on the image-receiving paper prepared in Example 1. In the image formed thereon, the optical densities (of yellow, magenta and cyan) were measured; and the spreadability of the ink was observed. The results are shown in Table 1.

Test Method

The optical densities of the image formed were measured in the same manner as in Example 1. The spreadability was evaluated in three ranks according to Standard II.

TABLE 1

| | Optical Density | | | Spreadability or |
|---|---|---|---|---|
| | Yellow | Magenta | Cyan | Releasability |
| Sublimation | 1.75 | 1.80 | 1.90 | A |
| Melt | 1.70 | 1.60 | 1.80 | A |
| Ink Jet | 1.50 | 1.60 | 1.70 | A |
| Letterpress | 1.55 | 1.60 | 1.70 | A |

B. Thermal Transfer Image-receiving Sheets for Recording Having a Receiving Layer on an Uneven Surface of Base Sheet Example 1

| (Production of Powdery Coating Composition) | |
|---|---|
| Saturated Polyester Resin (NE-382, product of Kao Corp.; having an acid value of 8.9 mg KOH/g) | 44% |
| Styrene-acrylic Copolymer Resin (TB-1804, product of Sanyo Chemical Co.) | 44% |
| Offset Inhibitor (Wax Biscol 330P, product of Sanyo Chemical Co.) | 4% |
| Titanium Oxide | 5% |
| Epoxy-modified Silicone Oil (KF-102, product of Shin-etsu Chemical Industry Co.) | 3% |

A raw material comprising the components above was mixed in a mixer, and then melt-kneaded in a double-screw melt-kneaded at a temperature of 150–160° C. for about 3–5 minutes. After having been cooled, the resulting mixture was ground and classified to provide a white powdery coating composition having a mean particle size of 10 μm. 100 parts of this powdery coating composition was mixed with 2 parts of hydrophobic silica (H-2000/4, product of Wacker-Chemie) to prepare a white powdery coating composition for use in dry coating in an electrostatic spraying process.

(Production of Thermal Transfer Image-receiving Sheet for Recording)

Using a commercially-available electrostatic spraying device, the white powdery coating composition prepared hereinabove was applied in about three layers or in a thickness of 30 μm onto commercially available common paper having an unevenness or undulation of more than 10 μm in height to make the composition adhered onto the entire surface of the paper. The coating composition was then heated, melted and fixed on the paper, thereby providing white image-receiving paper which had a receiving layer 10 μm thick. The thickness of the layer of the coating composition and the receiving layer were measured by means of a scanning electron microscope.

(Thermal Transfer of Sublimable Dyes onto Image-receiving Paper)

Using a high-speed printer for a sublimation thermal transfer process, an ink sheet mentioned below was attached to the thermal transfer image-receiving paper prepared hereinabove, with the surface of the dye layer of the former facing the receiving layer of the latter, and the ink sheet was heated with a thermal head thereby making the dyes transferred onto the receiving layer of the thermal transfer image-receiving paper. In the transfer image obtained herein, the optical densities (of yellow, magenta and cyan) were measured; and the releasability of the ink sheet from the image-transferred paper was observed. The results are shown in Table 2.

Transference Conditions Employed Herein for the High-speed Printer for Sublimation Thermal Transfer Process:

Thermal Head: KGT-219-12MPL2 (produced by Kyosera Co.)

Driving Voltage: 17 V

Line Speed: 4 ms

Sublimable Dyes in Ink Sheet:

Sublimable Yellow Dye: styryl-type yellow dye

Sublimable Magenta Dye: anthraquinone-type magenta dye

Sublimable Cyan Dye: indaniline-type cyan dye

Test Method:

For the optical densities of the transfer image formed, the reflection densities were measured with a densitometer (PDA-60, produced by Konica Co.).

To determine the releasability of the ink sheet from the image-transferred paper, the following four matters were checked from which the releasability was evaluated in three ranks according to Standard I:

(1) Possibility of high-speed printing.

(2) Presence or absence of white spots in the transfer image caused by the peeling of the receiving layer.

(3) Presence or absence of adhesion of the ink sheet to the receiving layer.

(4) Noise occurred when the ink sheet was peeled from the image-transferred paper.

(Thermal Transfer of Thermally Meltable Ink onto Image-receiving Paper)

Using a printer for a thermal melt transfer process (G370-70, produced by Mitsubishi Electric K.K.), an ink sheet mentioned below was attached to the image-receiving paper prepared in Example 1, and the ink sheet was heated with a thermal head thereby making the ink transferred onto the receiving layer of the image-receiving paper. In the transfer image obtained herein, the optical densities (of yellow, magenta and cyan) were measured, and the releasability of the ink sheet from the image-transferred paper was observed. The results are shown in Table 2.

Test Method

The optical densities of the transfer image formed were measured in the same manner as in Example 1 and the releasability of the ink sheet from the image-transferred paper was evaluated in three ranks in the same manner as in Example 1 according to Standard I. In addition, the spreadability of the ink was evaluated in three ranks according to Standard II.

Example 2

(Production of Powdery Coating Composition)

The same raw material as that used in Example 1 was mixed in a mixer, and then melt-kneaded in a double-screw melt-kneaded at a temperature of 150–160° C. for about 3–5 minutes. After having been cooled, the resulting mixture was ground and classified to provide a white powdery coating composition having a mean particle size of 10 μm. 100 parts of this powdery coating composition was mixed with 2 parts of hydrophobic silica (H-2000/4, product of Wacker-Chemie) to prepare a white powdery coating composition for use in dry coating in an electrostatic spraying process.

(Production of Thermal Transfer Image-receiving Sheet for Recording)

Using a commercially-available electrostatic spraying device, the white powdery coating composition prepared hereinabove was applied in about nine layers or in a thickness of 90 μm onto commercially available common paper to make the composition adhered onto the entire surface of the paper. The coating composition was then heated, melted and fixed on the paper, thereby providing white image-receiving paper which had a receiving layer 80 μm thick. The thickness of the layer of the coating composition and the receiving layer were measured by means of a scanning electron microscope.

(Thermal Transfer of Sublimable Dyes or Meltable Inks onto Image-receiving Paper)

An image was thermally transferred in the same manner as in Example 1 onto the image-receiving paper prepared hereinabove, and the transfer image obtained herein was evaluated. The results are shown in Table 2.

Comparative Example 1

(Production of Powdery Coating Composition)

The same raw material as that used in Example 1 was mixed in a mixer, and then melt-kneaded in a double-screw melt-kneaded at a temperature of 150–160° C. for about 3–5 minutes. After having been cooled, the resulting mixture was ground and classified to provide a white powdery coating composition having a mean particle size of 4 μm. 100 parts of this powdery coating composition was mixed with 2 parts of hydrophobic silica (H-2000/4, product of Wacker-Chemie) to prepare a white powdery coating composition for use in dry coating in an electrostatic spraying process.

(Production of Thermal Transfer Image-receiving Sheet for Recording)

Using a commercially-available electrostatic spraying device, the white powdery coating composition prepared hereinabove was applied in a single layer or in a thickness of 4 μm onto commercially available common paper to make the composition adhered onto the entire surface of the paper. The coating composition was then heated, melted and fixed on the paper, thereby providing white image-receiving paper which had a-receiving layer 1 μm thick. The thickness of the layer of the coating composition and the receiving layer were measured by means of a scanning electron microscope.

(Thermal Transfer of Sublimable Dyes or Meltable Inks onto Image-receiving Paper)

An image was thermally transferred in the same manner as in Example 1 onto the image-receiving paper prepared hereinabove, and the transfer image obtained herein was evaluated. The results are shown in Table 2.

TABLE 2

| | Optical Density | | | Spread- | Releas- |
|---|---|---|---|---|---|
| | Yellow | Magenta | Cyan | ability | ability |
| Example 1 | | | | | |
| Sublimation Transfer | 1.75 | 1.80 | 1.90 | A | A |
| Melt Transfer | 1.70 | 1.61 | 1.80 | A | A |

TABLE 2-continued

| | Optical Density | | | Spread- | Releas- |
|---|---|---|---|---|---|
| | Yellow | Magenta | Cyan | ability | ability |
| Example 2 | | | | | |
| Sublimation Transfer | 1.76 | 1.79 | 1.88 | A | A |
| Melt Transfer | 1.71 | 1.61 | 1.78 | A | A |
| Comparative Example 1 | | | | | |
| Sublimation Transfer | 1.75 | 1.80 | 1.85 | A with defects | Images |
| Melt Transfer | 1.71 | 1.60 | 1.77 | A with defects | Images |

C. Thermal Transfer Image-receiving Sheets for Recording Having a Controlled Surface Roughness Example 1

(Production of Powdery Coating Composition)

The same raw material as that used in Example 1 of B was mixed in a mixer, and then melt-kneaded in a double-screw melt-kneaded at a temperature of 150–160° C. for about 3–5 minutes. After having been cooled, the resulting mixture was ground and classified to provide a white powdery coating composition having a mean particle size of 10 μm. 100 parts of this powdery coating composition was mixed with 2 parts of hydrophobic silica (H-2000/4, product of Wacker-Chemie) to prepare a white powdery coating composition for use in dry coating in an electrostatic it spraying process.

(Production of Thermal Transfer Image-receiving Sheet for Recording)

Using a commercially-available electrostatic spraying device, the white powdery coating composition prepared hereinabove was applied onto commercially available common paper to make the composition adhered onto the entire surface of the paper. The coating composition was then heated, melted and fixed on the paper, thereby providing white image-receiving paper which had a receiving layer 20 μm thick.

The gloss of the surface of the thus prepared image-receiving paper was observed visually. The surface roughness of the receiving layer was measured with a surface roughness measuring device (Surftest-50, produced by Mitutoyo) in accordance with JIS B 0601-1994 with a standard length of 2.5 mm. The arithmetic mean roughness Ra was found to be 0.6 while the ten point mean roughness Rz was found to be 10.

(Thermal Transfer of Sublimable Dyes onto Image-receiving Paper)

Using a high-speed printer for a sublimation thermal transfer process, an ink sheet mentioned below was attached to the thermal transfer image-receiving paper prepared hereinabove, with the surface of the dye layer of the former facing the receiving layer of the latter, and the ink sheet was heated with a thermal head thereby making the dyes transferred onto the receiving layer of the thermal transfer image-receiving paper. In the transfer image obtained herein, the optical densities (of yellow, magenta and cyan) were measured; and the releasability of the ink sheet from the image-transferred paper was observed. The results are shown in Table 3.

Transference Conditions Employed Herein for the High-speed Printer for Sublimation Thermal Transfer Process:

Thermal Head: KGT-219-12MPL2 (produced by Kyosera Co.)

Driving Voltage: 17 V

Line Speed: 4 ms

Sublimable Dyes in Ink Sheet:

Sublimable Yellow Dye: styryl-type yellow dye

Sublimable Magenta Dye: anthraquinone-type magenta dye

Sublimable Cyan Dye: indaniline-type cyan dye

Test Method

For the optical densities of the transfer image formed, the reflection densities were measured with a densitometer (PDA-60, produced-by Konica Co.).

The releasability of the ink sheet from the image-transferred paper was evaluated in three ranks according to Standard I.

(Thermal Transfer of Thermally Meltable Ink onto Image-receiving Paper)

Using a printer for a thermal melt transfer process (G370-70, produced by Mitsubishi Electric K.K.), an ink sheet mentioned below was attached to the image-receiving paper prepared in Example 1, and the ink sheet was heated with a thermal head thereby making the ink transferred onto the receiving layer of the image-receiving paper. In the transfer image obtained herein, the optical densities (of yellow, magenta and cyan) were measured, and the releasability of the ink sheet from the image-transferred paper was observed. The results are shown in Table 3.

Test Method

The optical densities of the transfer image formed were measured in the same manner as in Example 1 and the releasability of the ink sheet from the image-transferred paper was evaluated in three ranks in the same manner as hereinbefore according to Standard I.

Comparative Example 1

(Thermal Transfer of Sublimable Dyes onto Image-receiving Paper)

Sublimable dyes were thermally transferred onto a commercially available sublimation transfer image-receiving sheet of which image-receiving layer had an arithmetic mean surface roughness Ra of 0.3 and ten point mean surface roughness Rz of 1.5 (in accordance with JIS B 0601-1994) in the same manner as in Example 1. The optical densities of the obtained image was measured and the releasability of the ink sheet from the image-transferred paper was observed. The gloss of the surface of the image-receiving sheet was visually evaluated. The results are shown in Table 3.

TABLE 3

| | Optical Density | | | | Spreada- bility or Releas- |
|---|---|---|---|---|---|
| | Yellow | Magenta | Cyan | Gloss | ability |
| Example 1 | | | | | |
| Sublimation Transfer | 1.75 | 1.80 | 1.90 | No | A |
| Melt Transfer | 1.70 | 1.61 | 1.80 | No | A |
| Comparative Example 1 | | | | | |
| Sublimation Transfer | 1.75 | 1.80 | 1.85 | Yes | A |

D. Thermal Transfer Image-receiving Sheets for Recording Containing a Releasing Agent Comprising a Cured Product of Saturated Polyester Resin and Epoxy-modified Silicone Oil In the following examples, the data as parenthesized indicate the proportions of the components relative to the resin component of being 100% by weight.

Example 1

| (Production of White Powdery Coating Composition) | |
|---|---|
| Saturated Polyester Resin (NE-382, product of Kao Corp.; having an acid value of 8.9 mg KOH/g and a glass transition point of 62.6° C.) | 71% (80.7%) |
| Styrene-acrylic Copolymer Resin (CPR-200, product of Mitsui Toatsu Chemical Co.) | 17% (19.3%) |
| Offset Inhibitor (Wax Biscol 330P, product of Sanyo Chemical Co.) | 4% |
| Titanium Oxide | 7% |
| Epoxy-modified Silicone Oil (KF-102, product of Shin-etsu Chemical Industry Co.) | 1% |

A raw material comprising the components above was mixed in a mixer, and then melt-kneaded in a double-screw melt-kneaded at a temperature of 150–160° C. for about 3–5 minutes. After having been cooled, the resulting mixture was ground and classified to provide a white powdery coating composition having a mean particle size of from 10 μm. 100 parts of this powdery coating composition was mixed with 2 parts of hydrophobic silica (H-2000/4, product of Wacker-Chemie) to prepare a white powdery coating composition for use in dry coating in an electrostatic spraying process.

(Production of Thermal Transfer Image-receiving Paper)

Using a commercially-available electrostatic spraying device, the white powdery coating composition prepared hereinabove was applied onto commercially available common paper to make the composition adhered onto the entire surface of the paper. The coating composition was then heated, melted and fixed on the paper, thereby providing white image-receiving paper which had a receiving layer 10 μm thick.

(Resistance to Yellowing)

The thus prepared image-receiving paper was left standing at a temperature of 35° C. and a relative humidity of 85% for a week and examined visually if yellowing took place. The mark A represents that yellowing did not take place while the mark C represents that yellowing took place.

(Thermal Transfer of Sublimable Dyes onto Image-receiving Paper)

Using a high-speed printer of a sublimation thermal transfer system, an ink sheet mentioned below was attached to the thermal transfer image-receiving paper prepared hereinabove, with the surface of the dye layer of the former facing the receiving layer of the latter, and the ink sheet was heated with a thermal head thereby making the dyes transferred onto the receiving layer of the thermal transfer image-receiving paper. In the transfer image obtained herein, the optical densities (of yellow, magenta and cyan) were measured; and the releasability of the ink sheet from the image-transferred paper was observed. The results are shown in Table 4.

Transference Conditions Employed Herein for the High-speed Printer for Sublimation Thermal Transfer Process:

Thermal Head: KGT-219-12MPL2 (produced by Kyosera Co.)

Driving Voltage: 17 V

Line Speed: 4 ms

Sublimable Dyes in Ink Sheet:

Sublimable Yellow Dye: styryl-type yellow dye

Sublimable Magenta Dye: anthraquinone-type magenta dye

Sublimable Cyan Dye: indaniline-type cyan dye

Test Method

For the optical densities of the transfer image formed, the reflection densities were measured with a densitometer (PDA-60, produced by Konica Co.).

The releasability of the ink sheet from the image-transferred paper was evaluated in three ranks according to Standard I.

(Thermal Transfer of Thermally Meltable Ink onto Image-receiving Paper)

Using a printer for a thermal melt transfer process (G370-70, produced by Mitsubishi Electric K.K.), an ink sheet mentioned below was attached to the image-receiving paper prepared in Example 1, and the ink sheet was heated with a thermal head thereby making the ink transferred onto the receiving layer of the image-receiving paper. In the transfer image obtained herein, the optical densities (of yellow, magenta and cyan) were measured, and the releasability of the ink sheet from the image-transferred paper was observed. The results are shown in Table 4.

Test Method

The optical densities of the transfer image formed were measured in the same manner as in Example 1 and the releasability of the ink sheet from the image-transferred paper was evaluated in three ranks in the same manner as hereinbefore according to Standard I. The spreadability of the ink was evaluated in three ranks according to Standard II. The results are shown in Table 4.

Example 2

In the same manner as in Example 1, except that the raw material comprised 71% of a saturated polyester resin, NE-1110 (product of Kao Corp.; having an acid value of 8.9 mg KOH/g and a glass transition point of 62.6° C.), there was obtained white thermal transfer image-receiving paper. This was subjected to the same thermal transfer test as in Example 1. The results are shown in Table 4.

Example 3

In the same manner as in Example 1, except that the raw material comprised 71% of a saturated polyester resin, Diaculon FC-545 (product of Mitsubishi Rayon Co.; having an acid value of 4.1 mg KOH/g and a glass transition point of 52.5° C.), there was obtained white thermal transfer image-receiving paper. This was subjected to the same thermal transfer test as in Example 1. The results are shown in Table 4.

Comparative Example 1

In the same manner as in Example 1, except that the raw material comprised 71% of a saturated polyester resin, Bailon RV220 (product of Toyo Boseki K.K.; having no acid value but having a glass transition point of 67° C.), there was obtained white thermal transfer image-receiving paper. This was subjected to the same thermal transfer test as in Example 1. The results are shown in Table 4.

Comparative Example 2

In the same manner as in Example 1, except that the raw material comprised 71% of a saturated polyester resin, Bailon RV600 (product of Toyo Boseki K.K.; having a glass transition point of 45° C.), there was obtained was white thermal transfer image-receiving paper. This was subjected to the same thermal transfer test as in Example 1. The results are shown in Table 4.

Comparative Example 3

In the same manner as in Example 1, except that the raw material comprised 71% of a saturated polyester resin, HP-301 (product of Nippon Synthetic Chemical Industry Co.; having an acid value of 30 mg KOH/g and a glass transition point of 62° C.), there was obtained was white thermal transfer image-receiving paper. This was subjected to the same thermal transfer test as in Example 1. The results are shown in Table 4.

Example 4

In the same manner as in Example 1, except that the raw material comprised a resin component comprising 78% (88.6%) of a saturated polyester resin, NE-382 (product of Kao Corp.) and 16% (11.4%) of a styrene-acrylic copolymer resin, CPR-200 (product of Mitsui Toatsu Chemical Co.), there was obtained white thermal transfer image-receiving paper. This was subjected to the same thermal transfer test as in Example 1. The results are shown in Table 4.

Example 5

In the same manner as in Example 1, except that the raw material comprised a resin component comprising 48% a (54.6) of a saturated polyester resin, NE-382 (product of Kao Corp.) and 40% (45.4%) of a styrene-acrylic copolymer resin, CPR-200 (product of Mitsui Toatsu Chemical Co.), there was obtained white thermal transfer image-receiving paper. This was subjected to the same thermal transfer test as in Example 1. The results are shown in Table 4.

Comparative Example 4

In the same manner as in Example 1, except that the raw material comprised a resin component comprising 10% (11.4%) of a saturated polyester resin, NE-382 (product of Kao Corp.) and 78% (88.6 %) of a styrene-acrylic copolymer resin, CPR-200 (product of Mitsui Toatsu Chemical Co.), there was obtained white thermal transfer image-receiving paper. This was subjected to the same thermal transfer test as in Example 1. The results are shown in Table 4.

Comparative Example 5

In the same manner as in Example 1, except that the raw material comprised a resin component of 88% (100%) of only a saturated polyester resin, NE-382 (product of Kao Corp.), there was obtained white thermal transfer image-receiving paper. This was subjected to the same thermal transfer test as in Example 1. The results are shown in Table 4.

Comparative Example 6

In the same manner as in Example 1, except that the raw material comprised a resin component of 88% (100%) of only a styrene-acrylic copolymer resin, CPR-200 (product of Mitsui Toatsu Chemical Co.), there was obtained white thermal transfer image-receiving paper. This was subjected to the same thermal transfer test as in Example 1. The results are shown in Table 4.

Comparative Example 7

In the same manner as in Example 1, except that the raw material comprised a resin component comprising 84% (95.5%) of a saturated polyester resin, NE-382 (product of Kao Corp.) and 4% (4.5%) of a styrene-acrylic copolymer resin, CPR-200 (product of Mitsui Toatsu Chemical Co.), there was obtained white thermal transfer image-receiving paper. This was subjected to the same thermal transfer test as in Example 1. The results are shown in Table 4.

Example 6

In the same manner as in Example 1, except that a raw material comprising the following components was used, there was obtained white thermal transfer image-receiving paper. This was subjected to the same thermal transfer test as in Example 1. The results are shown in Table 5.

| | |
|---|---|
| Saturated Polyester Resin (NE-382, product of Kao Corp.; having an acid value of 8.9 mg KOH/g and a glass transition point of 62.6° C.) | 68% (81.0%) |
| Styrene-acrylic Copolymer Resin (CPR-200, product of Mitsui Toatsu Chemical Co.) | 16% (19.0%) |
| Offset Inhibitor (Wax Biscol 330P, product of Sanyo Chemical Co.) | 4% |
| Titanium Oxide | 7% |
| Epoxy-modified Silicone Oil (KF-102, product of Shin-etsu Chemical Industry Co.) | 5% |

Example 7

In the same manner as in Example 1, except that a raw material comprising the following components was used, there was obtained white thermal transfer image-receiving paper. The paper was subjected to the same thermal transfer test as in Example 1. The results are shown in Table 5.

| | |
|---|---|
| Saturated Polyester Resin (NE-382, product of Kao Corp.; having an acid value of 8.9 mg KOH/g and a glass transition point of 62.6° C.) | 64% (81.0%) |
| Styrene-acrylic Copolymer Resin (CPR-200, product of Mitsui Toatsu Chemical Co.) | 15% (19.0%) |
| Offset Inhibitor (Wax Biscol 330P, product of Sanyo Chemical Co.) | 4% |
| Titanium Oxide | 7% |
| Epoxy-modified Silicone Oil (KF-102, product of Shin-etsu Chemical Industry Co.) | 10% |

Comparative Example 8

In the same manner as in Example 1, except that a raw material comprising the following components was used, there was obtained white thermal transfer image-receiving paper. The paper was subjected to the same thermal transfer test as in Example 1. The results are shown in Table 5.

| | |
|---|---|
| Saturated Polyester Resin (NE-382, product of Kao Corp.; having an acid value of 8.9 mg KOH/g and a glass transition point of 62.6° C.) | 71% (80.7%) |
| Styrene-acrylic Copolymer Resin (CPR-200, product of Mitsui Toatsu Chemical Co.) | 17% (19.3%) |
| Offset Inhibitor (Wax Biscol 330P, product of Sanyo Chemical Co.) | 4% |
| Titanium Oxide | 8% |

Comparative Example 9

In the same manner as in Example 1, except that a raw material comprising the following components was used, there was obtained white thermal transfer image-receiving paper. The paper was subjected to the same thermal transfer test as in Example 1. The results are shown in Table 5.

| | |
|---|---|
| Saturated Polyester Resin (NE-382, product of Kao Corp.; having an acid value of 8.9 mg KOH/g and a glass transition point of 62.6° C.) | 60.5% (80.7%) |
| Styrene-acrylic Copolymer Resin (CPR-200, product of Mitsui Toatsu Chemical Co.) | 14.5% (19.3%) |
| Offset Inhibitor (Wax Biscol 330P, product of Sanyo Chemical Co.) | 4% |
| Titanium Oxide | 7% |
| Epoxy-modified Silicone Oil (KF-102, product of Shin-etsu Chemical Industry Co.) | 14% |

Example 8

In the same manner as in Example 1, except that an epoxy-modified silicone oil having an epoxy equivalent of 4000 g/mol (KF-101, product of Shin-etsu Chemical Industry Co.) was used, there was obtained white thermal transfer image-receiving paper. This was subjected to the same thermal transfer test as in Example 1. The results are shown in Table 6.

Comparative Example 10

In the same manner as in Example 1, except that a raw material comprising the following components was used, there was obtained white thermal transfer image-receiving paper. The paper was subjected to the same thermal transfer test as in Example 1. The results are shown in Table 6.

| | |
|---|---|
| Saturated Polyester Resin (NE-382, product of Kao Corp.; having an acid value of 8.9 mg KOH/g and a glass transition point of 62.6 ° C.) | 71% (80.7%) |
| Styrene-acrylic Copolymer Resin (CPR-200, product of Mitsui Toatsu Chemical Co.) | 17% (19.3%) |
| Offset Inhibitor (Wax Biscol 330P, product of Sanyo Chemical Co.) | 4% |
| Titanium Oxide | 6% |
| Epoxy-modified Silicone Oil (KF-101, product of Shin-etsu Chemical Industry Co.) | 1% |
| Amino-modified Silicone Oil (KF-393, product of Shin-etsu Chemical Industry Co.) | 1% |

Comparative Example 11

In the same manner as in Example 1, except that an epoxy-modified silicone oil having an epoxy equivalent of 90 g/mol was used, there was obtained white thermal transfer image-receiving paper. This was subjected to the same thermal transfer test as in Example 1. The results are shown in Table 6.

TABLE 4

| | Examples | | | Comparative Examples | | | Examples | |
|---|---|---|---|---|---|---|---|---|
| | 1 | 2 | 3 | 1 | 2 | 3 | 4 | 5 |
| Sublimation Transfer Optical Density | | | | | | | | |
| Yellow | 1.72 | 1.70 | 1.71 | 1.35 | — | — | 1.70 | 1.60 |
| Magenta | 1.74 | 1.73 | 1.71 | 1.41 | — | — | 1.69 | 1.63 |
| Cyan | 1.84 | 1.81 | 1.85 | 1.46 | — | — | 1.69 | 1.69 |
| Releasability | A | A | A | A~B | C | C | A | A |
| Melt Transfer Optical Density | | | | | | | | |
| Yellow | 1.70 | 1.68 | 1.67 | 1.24 | — | — | 1.68 | 1.55 |
| Magenta | 1.64 | 1.62 | 1.61 | 1.29 | — | — | 1.55 | 1.51 |
| Cyan | 1.70 | 1.69 | 1.73 | 1.33 | — | — | 1.57 | 1.56 |
| Releasability | A | A | A | A~B | C | C | A | A |
| Spreadability | A | A | A | A | — | — | A | A |
| Resistance to Yellowing | A | A | A | C | A | A | A | A |

Notes:
— means that no images were transferred.

TABLE 5

| | Comparative Examples | | | | Examples | | Comparative | |
|---|---|---|---|---|---|---|---|---|
| | 4 | 5 | 6 | 7 | 6 | 7 | 8 | 9 |
| Sublimation Transfer Optical Density | | | | | | | | |
| Yellow | 1.30 | 1.67 | 1.42 | 1.65 | 1.71 | 1.68 | — | 1.41 |
| Magenta | 1.31 | 1.70 | 1.10 | 1.67 | 1.73 | 1.69 | — | 1.40 |
| Cyan | 1.31 | 1.76 | 1.33 | 1.68 | 1.80 | 1.70 | — | 1.38 |
| Releasability | A | B | A | B~C | A | A | C | A |
| Melt Transfer Optical Density | | | | | | | | |
| Yellow | 1.21 | 1.58 | 1.33 | 1.57 | 1.68 | 1.65 | — | 1.32 |
| Magenta | 1.19 | 1.59 | 0.98 | 1.56 | 1.62 | 1.57 | — | 1.29 |
| Cyan | 1.20 | 1.62 | 1.22 | 1.57 | 1.69 | 1.58 | — | 1.27 |
| Releasability | A | B | A | B~C | A | A | C | A |
| Spreadability | A | A | A | — | A | A | — | A |
| Resistance to Yellowing | A | A | A | A | A | A | A | A |

Notes:
— means that no images were transferred.

TABLE 6

| | Example | Comparative Examples | |
|---|---|---|---|
| | 8 | 10 | 11 |
| Sublimation Transfer Optical Density | | | |
| Yellow | 1.67 | 1.73 | — |
| Magenta | 1.67 | 1.72 | — |
| Cyan | 1.68 | 1.80 | — |
| Releasability | A | A | C |
| Melt Transfer Optical Density | | | |
| Yellow | 1.65 | 1.68 | — |
| Magenta | 1.58 | 1.60 | — |
| Cyan | 1.58 | 1.69 | — |
| Releasability | A | A | C |

TABLE 6-continued

| | Example | Comparative Examples | |
|---|---|---|---|
| | 8 | 10 | 11 |
| Spreadabilty | A | A | — |
| Resistance to Yellowing | A | C | A |

Notes:
"—" means that no images were transferred.

E. Thermal Transfer Image-receiving Sheets for Recording Having a Releasing Layer Comprising a Powdery Coating Composition Example 1

(Production of First White Powdery Coating Composition for Receiving Layer (First Resin Layer))

A mixture of 95 parts of saturated polyester resin (NE-382, product of Kao Corp.; having an acid value of 8.9 mg KOH/g) and 5 parts of titanium oxide was melt-kneaded in a double-screw melt-kneaded at a temperature of 150–160° C. for about 3–5 minutes. After having been cooled, the resulting mixture was ground and classified to provide a white powdery coating composition having a mean particle size of from 10 μm. 100 parts of this powdery coating composition was mixed with 2 parts of hydrophobic silica (H-2000/4, product of Wacker-Chemie) to prepare a white powdery coating composition for use in dry coating in an electrostatic spraying process.

(Production of Second Powdery Coating Composition for Releasing Layer (Second Resin Layer))

Styrene-acrylic copolymer resin (CPR-200, product of Mitsui Toatsu Chemical Co.) was melt-kneaded in a double-screw melt-kneaded at a temperature of 150–160° C. for about 3–5 minutes. After having been cooled, the resin was ground and classified to provide a powdery coating composition having a mean particle size of 10 μm. 100 parts of this powdery coating composition was mixed with 2 parts of hydrophobic silica (H-2000/4, product of Wacker-Chemie) to prepare a second powdery coating composition for use in dry coating in an electrostatic spraying process.

(Production of Thermal Transfer Image-receiving Paper)

Using a commercially-available electrostatic spraying device, the first white powdery coating composition prepared hereinabove was applied onto commercially available common paper to make the composition adhered onto the entire surface of the paper. The coating composition was then heated, melted and fixed on the paper, thereby forming a receiving layer having a thickness of 10 μm. Then, in the same manner, the second powdery coating composition was applied onto the receiving layer to make the composition adhered thereonto, heated, melted and fixed, thereby forming a releasing layer having a thickness of 2 μm. In this way, a thermal transfer image-receiving paper was prepared.

(Thermal Transfer of Sublimable Dyes onto Image-receiving Paper)

Using a high-speed printer for a sublimation thermal transfer process, an ink sheet mentioned below was attached to the thermal transfer image-receiving paper prepared hereinabove, with the surface of the dye layer of the former facing the receiving layer of the latter, and the ink sheet was heated with a thermal head thereby making the dyes transferred onto the receiving layer of the thermal transfer image-receiving paper. In the transfer image obtained herein, the optical densities (of yellow, magenta and cyan) were measured; and the releasability of the ink sheet from the image-transferred paper was observed. The results are shown in Table 7.

Transference Conditions Employed Herein for the High-speed Printer for Sublimation Thermal Transfer Process:

Thermal Head: KGT-219-12MPL2 (produced by Kyosera Co.)

Driving Voltage: 17 V

Line Speed: 4 ms

Sublimable Dyes in Ink Sheet:

Sublimable Yellow Dye: styryl-type yellow dye

Sublimable Magenta Dye: anthraquinone-type magenta dye

Sublimable Cyan Dye: indaniline-type cyan dye

Test Method

For the optical densities of the transfer image formed, the reflection densities were measured with a densitometer (PDA-60, produced by Konica Co.).

The releasability of the ink sheet from the image-transferred paper was evaluated in three ranks according to Standard I. The spreadability of the ink was evaluated in three ranks according to Standard II.

(Thermal Transfer of Thermally Meltable Ink onto Image-receiving Paper)

Using a printer for a thermal melt transfer process (G370-70, produced by Mitsubishi Electric K.K.), an ink sheet mentioned below was attached to the image-receiving paper prepared in Example 1, and the ink sheet was heated with a thermal head thereby making the ink transferred onto the receiving layer of the image-receiving paper. In the transfer image obtained herein, the optical densities (of yellow, magenta and cyan) were measured, and the releasability of the ink sheet from the image-transferred paper and the spreadability of the ink were evaluated. The results are shown in Table 7.

Test Method

The optical densities of the transfer image formed were measured in the same manner as above. The releasability from the ink sheet was evaluated in three ranks according to Standard I. The spreadability of the ink was evaluated in three ranks according to Standard II.

Example 2

A receiving layer was formed on commercially available common paper in the same manner as in Example 1, and then finely divided silica powder (H-2000/4, having a mean particle size of 15 nm, product of Wacker-Chemie) was sprayed onto the receiving layer, followed by heating to fix the silica on the receiving layer, thereby producing a thermal transfer image-receiving paper. This was subjected to the same thermal transfer of sublimable dyes or meltable inks as in Example 1. The results are shown in Table 7.

Example 3

A receiving layer was formed on commercially available common paper in the same manner as in Example 1, and then finely divided powder of polymethyl methacrylate (MP-1000, having an average particle size of 0.4 μm, product of Soken Kagaku K.K.) was sprayed onto the receiving layer, followed by heating to fix the polymer powder on the receiving layer, thereby producing a thermal transfer image-receiving paper. This was subjected to the same thermal transfer of sublimable dyes or meltable inks as in Example 1. The results are shown in Table 7.

TABLE 2

| | Optical Density | | | Spread- | Releas- |
|---|---|---|---|---|---|
| | Yellow | Magenta | Cyan | ability | ability |
| Example 1 | | | | | |
| Sublimation Transfer | 1.75 | 1.80 | 1.90 | A | A |
| Melt Transfer | 1.70 | 1.60 | 1.80 | A | A |
| Example 2 | | | | | |
| Sublimation Transfer | 1.73 | 1.79 | 1.88 | A | A |
| Melt Transfer | 1.68 | 1.62 | 1.81 | A | A |
| Example 3 | | | | | |
| Sublimation Transfer | 1.78 | 1.77 | 1.88 | A | A |
| Melt Transfer | 1.71 | 1.59 | 1.77 | A | A |

F. Thermal Transfer Image-receiving Sheets for Recording Having a Releasing Layer Comprising a Cured Product of Epoxy-modified Silicone Oil Example 1

(Production of First White Powdery Coating Composition for Receiving Layer (First Resin Layer))

A mixture of 95 parts of saturated polyester resin (NE-382, product of Kao Corp.; having an acid value of 8.9 mg KOH/g) and 5 parts of titanium oxide was melt-kneaded in a double-screw melt-kneaded at a temperature of 150–160° C. for about 3–5 minutes. After having been cooled, the resulting mixture was ground and classified to provide a white powdery coating composition having a mean particle size of 10 $\mu$m. 100 parts of this powdery coating composition was mixed with 2 parts of hydrophobic silica (H-2000/4, product of Wacker-Chemie) to prepare a white powdery coating composition for use in dry coating in an electrostatic spraying process.

(Production of Thermal Transfer Image-receiving Paper)

Using a commercially-available electrostatic spraying device, the first white powdery coating composition prepared hereinabove was applied onto commercially available common paper to make the composition adhered onto the entire surface of the paper. The coating composition was then heated, melted and fixed on the paper, thereby forming a receiving layer having a thickness of 10 $\mu$m. Then, an epoxy-modified silicone oil (KF-102, product of Shin-etsu Chemical Industry Co.) was applied onto the receiving layer, heated and cured, thereby forming a releasing layer on the receiving layer. The gloss of the surface of the image-receiving sheet thus prepared was visually observed. The results are shown in Table 8.

(Thermal Transfer of Sublimable Dyes onto Image-receiving Paper)

Using a high-speed printer for a sublimation thermal transfer process, an ink sheet mentioned below was attached to the thermal transfer image-receiving paper prepared hereinabove, with the surface of the dye layer of the former facing the receiving layer of the latter, and the ink sheet was heated with a thermal head thereby making the dyes transferred onto the receiving layer of the thermal transfer image-receiving paper. In the transfer image obtained herein, the optical densities (of yellow, magenta and cyan) were measured, and the releasability of the ink sheet from the image-transferred paper and the spreadability of the ink were evaluated. The results are shown in Table 8.

Transference Conditions Employed Herein for the High-speed Printer for Sublimation Thermal Transfer Process:

Thermal Head: KGT-219-12MPL2 (produced by Kyosera Co.)

Driving Voltage: 17 V

Line Speed: 4 ms

Sublimable Dyes in Ink Sheet:

Sublimable Yellow Dye: styryl-type yellow dye

Sublimable Magenta Dye: anthraquinone-type magenta dye

Sublimable Cyan Dye: indaniline-type cyan dye

Test Method

For the optical densities of the transfer image formed, the reflection densities were measured with a densitometer (PDA-60, produced by Konica Co.).

The releasability of the ink sheet from the image-transferred paper was evaluated in three ranks according to Standard I. The spreadability of the ink was evaluated in three ranks according to Standard II.

(Thermal Transfer of Thermally Meltable Ink onto Image-receiving Paper)

Using a printer of a thermal melt transfer system (G370-70, produced by Mitsubishi Electric K.K.), an ink sheet mentioned below was attached to the image-receiving paper prepared in Example 1, and the ink sheet was heated with a thermal head thereby making the ink transferred onto the receiving layer of the image-receiving paper. In the transfer image obtained herein, the optical densities (of yellow, magenta and cyan) were measured, and the releasability of the ink sheet from the image-transferred paper and the spreadability of the ink were evaluated. The results are shown in Table 8.

Test Method

The optical densities of the transfer image formed were measured in the same manner as above. The releasability from the ink sheet was evaluated in three ranks according to Standard I. The spreadability of the ink was evaluated in three ranks according to Standard II.

Example 2

A receiving layer was formed on commercially available common paper in the same manner as in Example 1, and then an acetone solution of styrene-acrylic copolymer resin (CPR-200, product of Mitsui Toatsu Chemical Co.) was applied onto the receiving layer, followed by heating and drying the solution of resin to form a releasing layer comprised of the styrene-acrylic copolymer resin on the receiving layer, thereby producing a thermal transfer image-receiving sheet. The gloss of the surface of the image-receiving sheet thus prepared was visually observed in the same manner as in Example 1. The image-receiving sheet was subjected to the same test for thermal transfer of sublimable dyes or meltable inks as in Example 1. The results are shown in Table 8.

TABLE 8

| | Optical Density | | | | | |
|---|---|---|---|---|---|---|
| | Yel-low | Magen-ta | Cyan | Gloss | Spread-ability | Releas-ability |
| Example 1 | | | | | | |
| Sublimation Transfer | 1.75 | 1.80 | 1.90 | No | A | A |
| Melt Transfer | 1.70 | 1.60 | 1.80 | No | A | A |
| Example 2 | | | | | | |
| Sublimation Transfer | 1.73 | 1.79 | 1.88 | No | A | A |
| Melt Transfer | 1.68 | 1.62 | 1.81 | No | A | A |

G. Thermal Transfer Image-receiving Sheets for Recording Having Image-receiving Layers on Both sides of Base Paper Example 1

| (Production of Powdery Coating Composition) | |
|---|---|
| Saturated Polyester Resin (NE-382, product of Kao Corp.; having an acid value of 8.9 mg KOH/g) | 44% |
| Styrene-acrylic Copolymer Resin (TB-1804, product of Sanyo Chemical Co.) | 44% |
| Offset Inhibitor (Wax Biscol 330P, product of Sanyo Chemical Co.) | 4% |
| Titanium Oxide | 5% |
| Epoxy-modified Silicone Oil (KF-102, product of Shin-etsu Chemical Industry Co.) | 3% |

A raw material comprising the components above was mixed in a mixer, and then melt-kneaded in a double-screw melt-kneaded at a temperature of 150–160° C. for about 3–5 minutes. After having been cooled, the resulting mixture was ground and classified to provide a white powdery coating composition having a mean particle size of 10 $\mu$m. 100 parts of this powdery coating composition was mixed with 2 parts of hydrophobic silica (H-2000/4, product of Wacker-Chemie) to prepare a white powdery coating composition for use in dry coating in an electrostatic spraying process.

(Production of Thermal Transfer Image-receiving Paper)

Using a commercially-available electrostatic spraying device, the white powdery coating composition prepared hereinabove was applied onto a surface of commercially available common paper to make the composition adhered onto the entire surface, heated, melted and fixed on the paper to form a receiving layer 10 $\mu$m thick. Then, in the same manner, the white powdery coating composition was applied onto the other surface of the paper, heated, melted and fixed on the paper to form a receiving layer 10 $\mu$m thick, thereby producing a thermal transfer image-receiving paper having the image-receiving layers on both sides.

(Thermal Transfer of Sublimable Dyes onto Image-receiving Paper)

Using a high-speed printer for a sublimation thermal transfer process, an ink sheet mentioned below was attached to the thermal transfer image-receiving paper prepared hereinabove, with the surface of the dye layer of the former facing the receiving layer of the latter, and the ink sheet was heated with a thermal head thereby making the dyes transferred onto the receiving layer of the thermal transfer image-receiving paper. In the transfer image obtained herein, the optical densities (of yellow, magenta and cyan) were measured; and the releasability of the ink sheet from the image-transferred paper was observed. The results are shown in Table 9.

Transference Conditions Employed Herein for the High-speed Printer for Sublimation Thermal Transfer Process:

Thermal Head: KGT-219-12MPL2 (produced by Kyosera Co.)

Driving Voltage: 17 V

Line Speed: 4 ms

Sublimable Dyes in Ink Sheet:

Sublimable Yellow Dye: styryl-type yellow dye

Sublimable Magenta Dye: anthraquinone-type magenta dye

Sublimable Cyan Dye: indaniline-type cyan dye

Test Method

The optical densities of the transfer image formed were measured in the same manner as above. The releasability from the ink sheet was evaluated in three ranks according to Standard I. The spreadability of the ink was evaluated in three ranks according to Standard II.

(Thermal Transfer of Thermally Meltable Ink onto Image-receiving Paper)

Using a printer for a thermal melt transfer process (G370-70, produced by Mitsubishi Electric K.K.), an ink sheet mentioned below was attached to the image-receiving paper prepared in Example 1, and the ink sheet was heated with a thermal head thereby making the ink transferred onto the receiving layer of the image-receiving paper. In the transfer image obtained herein, the optical densities (of yellow, magenta and cyan) were measured, and the releasability of the ink sheet from the image-transferred paper was observed, The results are shown in Table 9.

Test Method

The optical densities of the transfer image formed were measured in the same manner as above. The releasability from the ink sheet was evaluated in three ranks according to Standard I. The spreadability of the ink was evaluated in three ranks according to Standard II.

TABLE 9

| | Optical Density | | | | | |
|---|---|---|---|---|---|---|
| | Yel-low | Magen-ta | Cyan | Releas-ability | Spread-ability | Re-marks |
| Sublimation Transfer | 1.75 | 1.80 | 1.90 | A | A | Front |
| Melt Transfer | 1.76 | 1.79 | 1.88 | A | A | Back |
| Sublimation Transfer | 1.70 | 1.60 | 1.80 | A | A | Front |
| Melt Transfer | 1.71 | 1.61 | 1.78 | A | A | Back |

H. Thermal Transfer Image-receiving Sheets for Recording Having a Second Resin Layer on Back Side of Base Paper Example 1

| (Production of Powdery Coating Composition for Receiving Layer (First Resin Layer)) | |
|---|---|
| Saturated Polyester Resin (NE-382, product of Kao Corp.; having an acid value of 8.9 mg KOH/g) | 44% |
| Styrene-acrylic Copolymer Resin (TB-1804, product of Sanyo Chemical Co.) | 44% |
| Offset Inhibitor (Wax Biscol 330P, product of Sanyo Chemical Co.) | 4% |
| Titanium Oxide | 5% |
| Epoxy-modified Silicone Oil (KF-102, product of Shin-etsu Chemical Industry Co.) | 3% |

A raw material comprising the components above was mixed in a mixer, and then melt-kneaded in a double-screw melt-kneaded at a temperature of 150–160° C. for about 3–5 minutes. After having been cooled, the resulting mixture was ground and classified to provide a white powdery coating composition having a mean particle size of 10 $\mu$m. 100 parts of this powdery coating composition was mixed with 2 parts of hydrophobic silica (H-2000/4, product of Wacker-Chemie) to prepare a white powdery coating composition for use in dry coating in an electrostatic spraying process.

(Production of Second Powdery Coating Composition for Second Resin Layer)

Styrene-acrylic copolymer resin (CPR-200, product of Mitsui Toatsu Chemical Co.) was melt-kneaded in a double-screw melt-kneaded at a temperature of 150–160° C. for about 3–5 minutes. After having been cooled, the resin was ground and classified to provide a powdery coating composition having a mean particle size of 10 μm. 100 parts of this powdery coating composition was mixed with 2 parts of hydrophobic silica (H-2000/4, product of Wacker-Chemie) to prepare a second powdery coating composition for use in dry coating in an electrostatic spraying process.

(Production of Thermal Transfer Image-receiving Paper)

Using a commercially-available electrostatic spraying device, the first white powdery coating composition prepared hereinabove was applied onto a surface of commercially available common paper to make the composition adhered onto the entire surface, heated, melted and fixed on the paper to form a receiving layer 10 μm thick. Then, in the same manner, the second powdery coating composition was applied onto the other surface of the paper, heated, melted and fixed on the paper to form a resin layer 10 μm thick, thereby producing a thermal transfer image-receiving paper having the first resin layer as a receiving layer on the surface of paper and the second resin layer on the back side.

(Thermal Transfer of Sublimable Dyes onto Image-receiving Paper)

Using a high-speed printer for a sublimation thermal transfer process, an ink sheet mentioned below was attached to the thermal transfer image-receiving paper prepared hereinabove, with the surface of the dye layer of the former facing the receiving layer of the latter, and the ink sheet was heated with a thermal head thereby making the dyes transferred onto the receiving layer of the thermal transfer image-receiving paper. In the transfer image obtained herein, the optical densities (of yellow, magenta and cyan) were measured; and the releasability of the ink sheet from the image-transferred paper was observed. The results are shown in Table 10.

Transference Conditions Employed Herein for the High-speed Printer for Sublimation Thermal Transfer Process:

Thermal Head: KGT-219-12MPL2 (produced by Kyosera Co.)

Driving Voltage: 17 V

Line Speed: 4 ms

Sublimable Dyes in Ink Sheet:

Sublimable Yellow Dye: styryl-type yellow dye

Sublimable Magenta Dye: anthraquinone-type magenta dye

Sublimable Cyan Dye: indaniline-type cyan dye

Test Method

The optical densities of the transfer image formed were measured in the same manner as above. The releasability from the ink sheet was evaluated in three ranks according to Standard I. The spreadability of the ink was evaluated in three ranks according to Standard II.

(Thermal Transfer of Thermally Meltable Ink onto Image-receiving Paper)

Using a printer for a thermal melt transfer process (G370-70, produced by Mitsubishi Electric K.K.), an ink sheet mentioned below was attached to the image-receiving paper prepared in Example 1, and the ink sheet was heated with a thermal head thereby making the ink transferred onto the receiving layer of the image-receiving paper. In the transfer image obtained herein, the optical densities (of yellow, magenta and cyan) were measured, and the releasability of the ink sheet from the image-transferred paper was observed. The results are shown in Table 10.

Test Method

The optical densities of the transfer image formed were measured in the same manner as above. The releasability from the ink sheet was evaluated in three ranks according to Standard I. The spreadability of the ink was evaluated in three ranks according to Standard II.

TABLE 10

| | Optical Density | | | Releas- | Spread- |
|---|---|---|---|---|---|
| | Yellow | Magenta | Cyan | ability | ability |
| Sublimation Transfer | 1.75 | 1.80 | 1.90 | A | A |
| Melt Transfer | 1.70 | 1.60 | 1.80 | A | A |

(Resistance to Curling)

A-4 size image-receiving paper was left standing on a horizontal floor at a temperature of 35° C. and a relative humidity of 85% for 8 hours to examine if the corners of the paper were lifted from the floor. The lifting of the corners from the floor was found to be 2 mm in average. When the lifting is less than 5 mm, the image-receiving paper is practically used with no problem, however, when the lifting is more than 5 mm, there arise some problems in practical use of the receiving paper.

Example 2

A receiving layer was formed on a surface of base paper in the same manner as in Example 1 and then a film o polyethylene terephthalate was glued to the back of the paper, thereby producing an image-receiving paper. This paper was found to have no lifting.

Example 3

A receiving layer was formed on a surface of base paper in the same manner as in Example 1 and then an acetone solution of polystyrene was applied to the back of the paper and dried to form a layer of polystyrene, thereby producing an image-receiving paper. This paper was found to have a lifting of 3 mm in average.

Comparative Example 1

A receiving layer was formed on a surface of base paper in the same manner as in Example 1, but no resin layer was formed on the back of the paper. The resultant image-receiving paper was found to have a lifting of 18 mm in average.

What is claimed is:

1. A thermal transfer image-receiving sheet which, when a thermal transfer sheet having a layer of dye or ink on a support is attached thereto under heat, can receive the dye or ink thermally transferred from the thermal transfer sheet, wherein the thermal transfer image-receiving sheet has a receiving layer on a base sheet and a releasing layer thereon, the receiving layer comprising a powdery coating composition which contains at least one first resin and receives the dye or ink from the thermal transfer sheet and the releasing layer comprising at least one second resin which is releasable from the thermal transfer sheet.

2. A thermal transfer image-receiving sheet as claimed in claim 1, wherein said at least one first resin is saturated polyester resin and the at least one second resin is styrene-acrylic copolymer resin.

3. A thermal transfer image-receiving sheet which, when a thermal transfer sheet having a layer of dye or ink on a support is attached thereto under heat, can receive the dye or ink thermally transferred from the thermal transfer sheet, wherein the thermal transfer image-receiving sheet has a receiving layer on a base sheet and a releasing layer thereon, the receiving layer comprising a powdery coating composition which contains at least one first resin receptive to the dye or ink from the thermal transfer sheet and the releasing layer comprising minute inorganic or organic particles releasable from the thermal transfer sheet.

4. A process for the production of thermal transfer image-receiving sheet which, when a thermal transfer sheet having a layer of dye or ink on a support is attached thereto under heat, can receive the dye or ink thermally transferred from the thermal transfer sheet, which comprises dry-coating a powdery coating composition which contains at least one resin receptive to the dye or ink from the thermal transfer sheet on a base sheet by an electrostatic spraying process; heating, melting and fixing the powdery coating composition thereon to form a resin layer as a dye- or ink-receiving layer; dry-coating minute inorganic or organic particles releasable from the thermal transfer sheet on the receiving layer; and fixing the particles-on the receiving layer to form a releasing layer on the-receiving layer.

5. A thermal transfer image-receiving sheet which, when a thermal transfer sheet having a layer of dye or ink on a support is attached thereto under heat, can receive the dye or ink thermally transferred from the thermal transfer sheet, wherein the thermal transfer image-receiving sheet has a receiving layer on a base sheet and a releasing layer thereon, the receiving layer comprising a powdery coating composition which contains at least one resin receptive to the dye or ink from the thermal transfer sheet and the releasing layer comprising a dried product of reaction-curable silicone oil releasable from the thermal transfer sheet.

6. A thermal transfer image-receiving sheet as claimed in claim 5, wherein the at least one resin is saturated polyester resin and the reaction-curable silicone oil is an epoxy-modified silicone oil.

7. A process for the production of thermal transfer image-receiving sheet which, when a thermal transfer sheet having a layer of dye or ink on a support is attached thereto under heat, can receive the dye or ink thermally transferred from the thermal transfer sheet, which comprises dry-coating a powdery coating composition which contains at least one resin receptive to the dye or ink from the thermal transfer sheet on a base sheet by an electrostatic spraying process; heating, melting and fixing the powdery coating composition thereon to form a resin layer as a dye- or ink-receiving layer; coating a reaction-curable silicone oil on the receiving layer; and heating and drying the reaction-curable silicone oil to form a releasing layer on the receiving layer.

8. A process as claimed in claim 7 wherein said at least one resin is saturated polyester resin and the reaction-curable silicone oil is an epoxy-modified silicone oil.

9. A process for the production of thermal transfer image-receiving sheet which, when a thermal transfer sheet having a layer of dye or ink on a support is attached thereto under heat, can receive the dye or ink thermally transferred from the thermal transfer sheet, wherein the thermal transfer image-receiving sheet has a receiving layer on a base sheet and a releasing layer thereon, the receiving layer comprising a powdery coating composition which contains at least one first resin and receives the dye or ink from the thermal transfer sheet and the releasing layer comprising at least one second resin which is releasable from the thermal transfer sheet, which process comprises dry-coating a powdery coating composition which contains at least one first resin receptive to the dye or ink from the thermal transfer sheet on a base sheet by an electrostatic spraying process; and heating, melting and fixing the powdery coating composition thereon to form a first resin layer as a receiving layer for the dye or ink from the thermal transfer sheet; and forming a second resin layer on the receiving layer, the second resin layer comprising at least one second resin releasable from the thermal transfer sheet.

* * * * *